US007451726B1

(12) United States Patent
Sporea

(10) Patent No.: US 7,451,726 B1
(45) Date of Patent: Nov. 18, 2008

(54) PETER SPOREA'S FUEL INJECTOR ROTARY MOTOR

(75) Inventor: Peter Sorin Sporea, Coral Springs, FL (US)

(73) Assignee: Peter Sporea

( * ) Notice: Subject to any disclaimer, the term of this patent is extended or adjusted under 35 U.S.C. 154(b) by 416 days.

(21) Appl. No.: 11/546,508

(22) Filed: May 10, 2005

(51) Int. Cl.
*F01B 13/06* (2006.01)

(52) U.S. Cl. ..... 123/44 R; 123/241

(58) Field of Classification Search ..... 123/44 R
See application file for complete search history.

(56) References Cited

U.S. PATENT DOCUMENTS 4,078,529 A * 3/1978 Warwick ..... 123/44 C

* cited by examiner

*Primary Examiner*—Thomas Denion
*Assistant Examiner*—Douglas J. Duff

(57) ABSTRACT

This Rotary engine with pistons, a stator and a power chamber is comprising a Stator, which contains the power chamber for combusting a mixture of fuel and air; an air intake slot, exhaust slots and the power chamber located along an inside periphery of stator; a Rotor containing three of said pistons and three cylinders that create compression of the mixture of fuel and air; and an Eccentric Shaft for attachment to said pistons, said eccentric shaft moving said pistons in a inwardly and outwardly direction; the rotor further containing three pallets, which create a movable wall at an outer circumferential periphery of the rotor, said walls slide into the power chamber cavity of the stator; the rotor block has three equally spaced slots for mounting the three pallets, the Pallets, moves into the power chamber cavity during ignition of the compressed fuel and air mixture to enable the pallets and rotor to be pushed along the power chamber cavity, creating the rotation of the rotor.

1 Claim, 41 Drawing Sheets

(SEE FIGS)

Figure3.1 (Motor's Assembly & thru View)
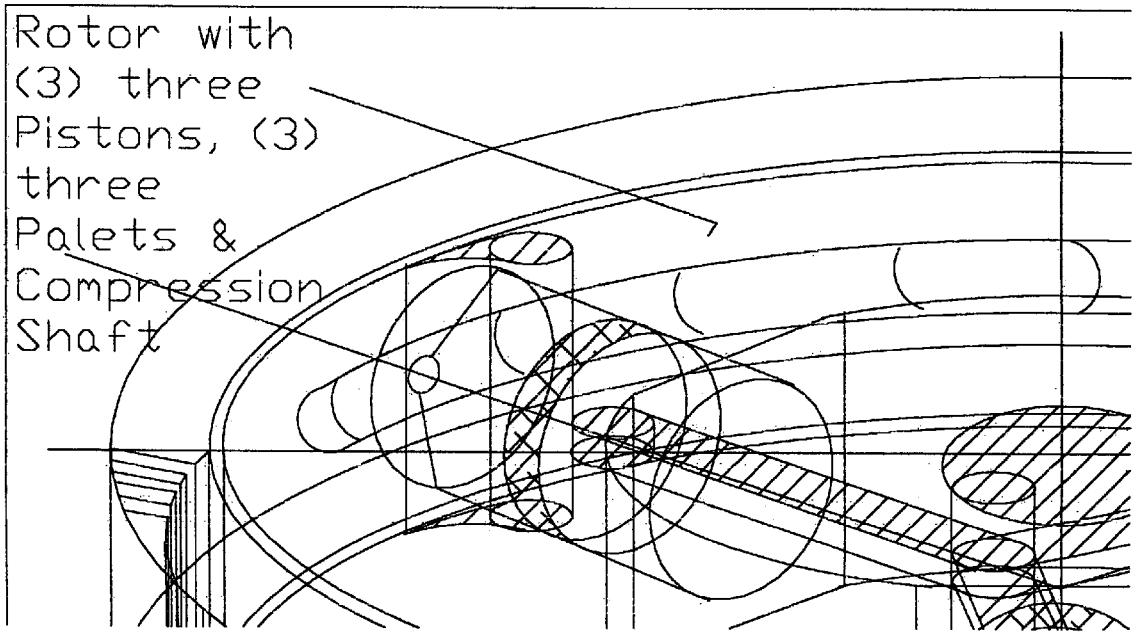

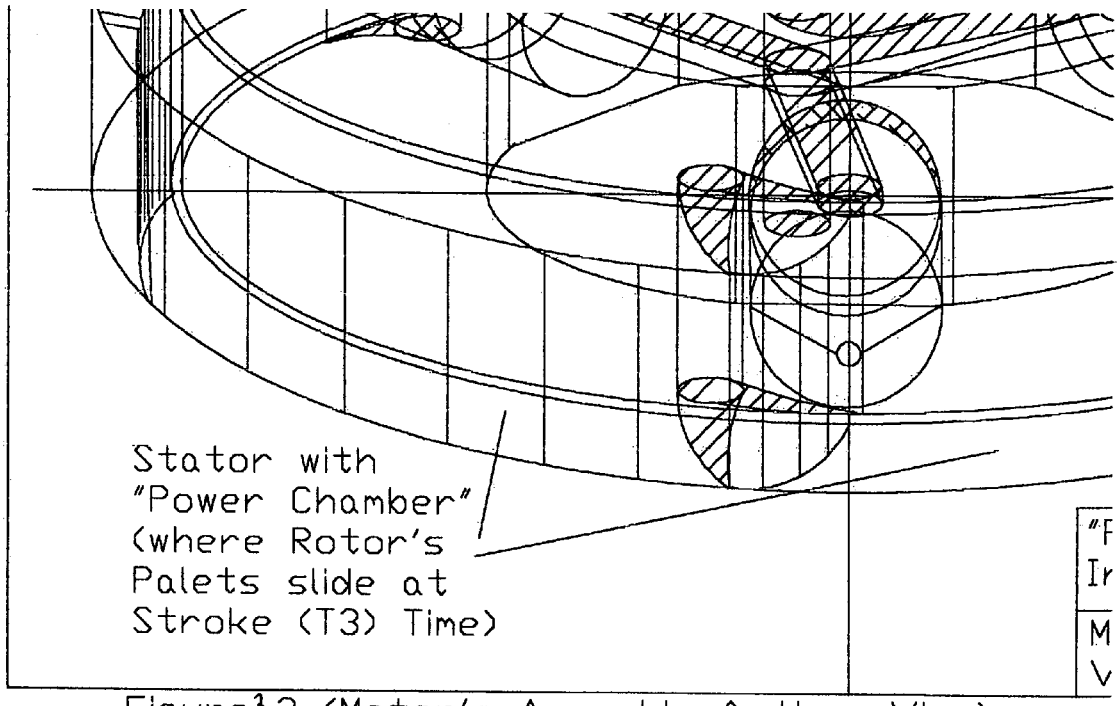
Figure3.2 (Motor's Assembly & thru View)

(SEE FIGS)

Figure6.1 (Stator (the block)
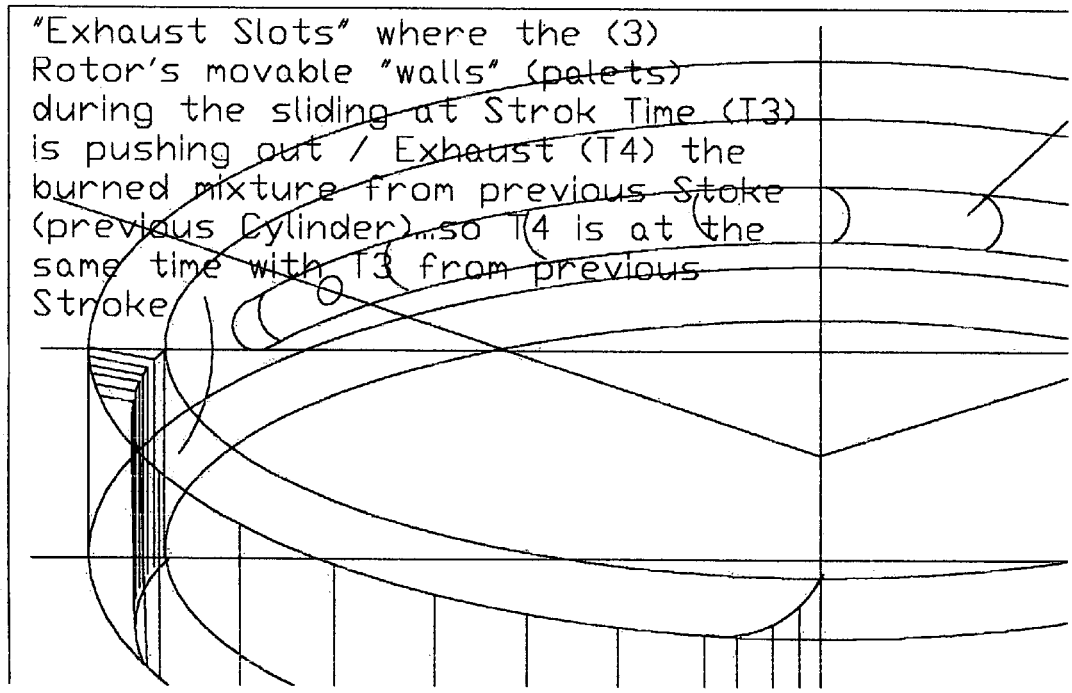

Figure6.2 (Stator - the block)
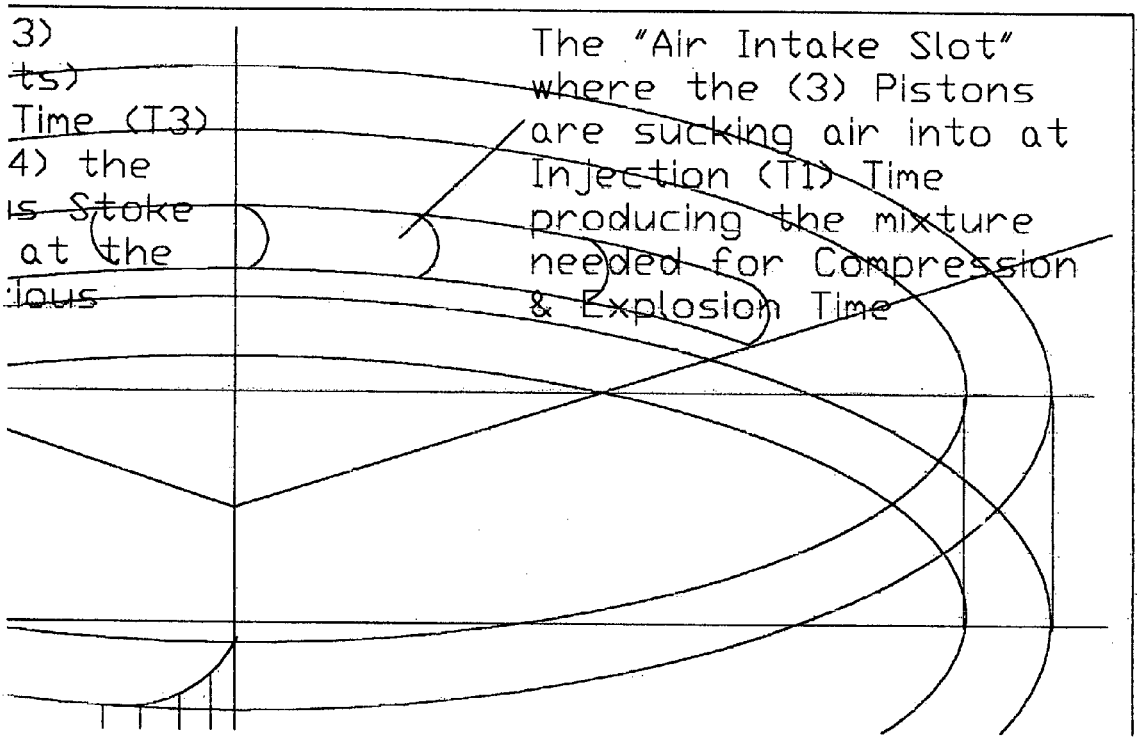

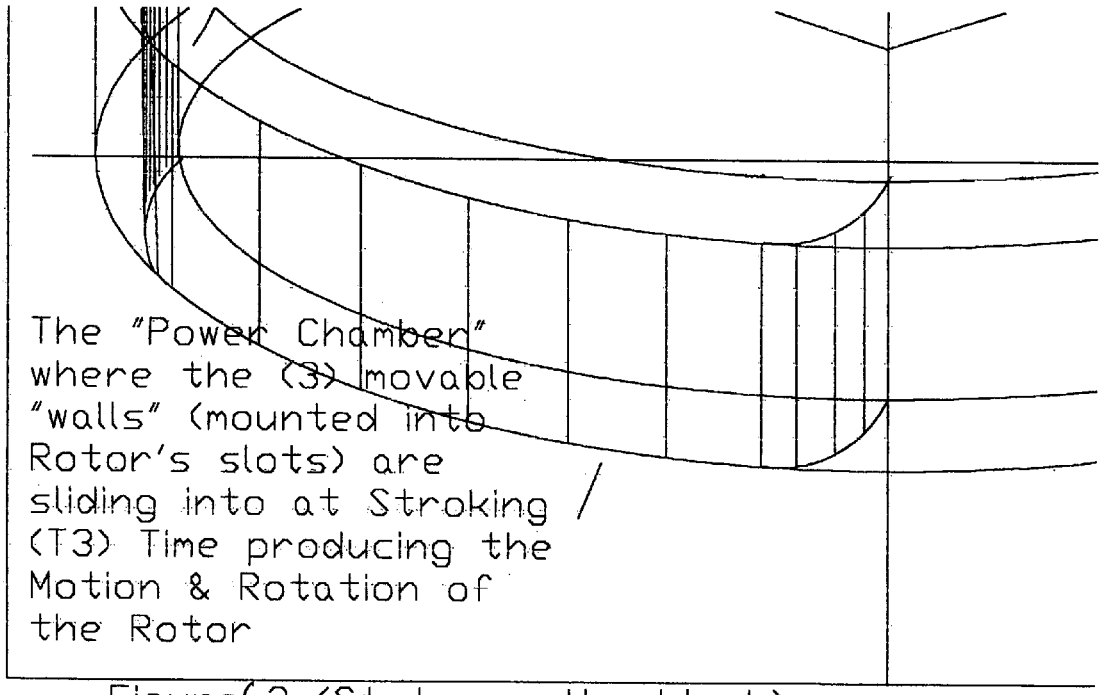
Figure6.3 (Stator - the block)

(SEE FIGS)

Figure 10.K Stator - the block)
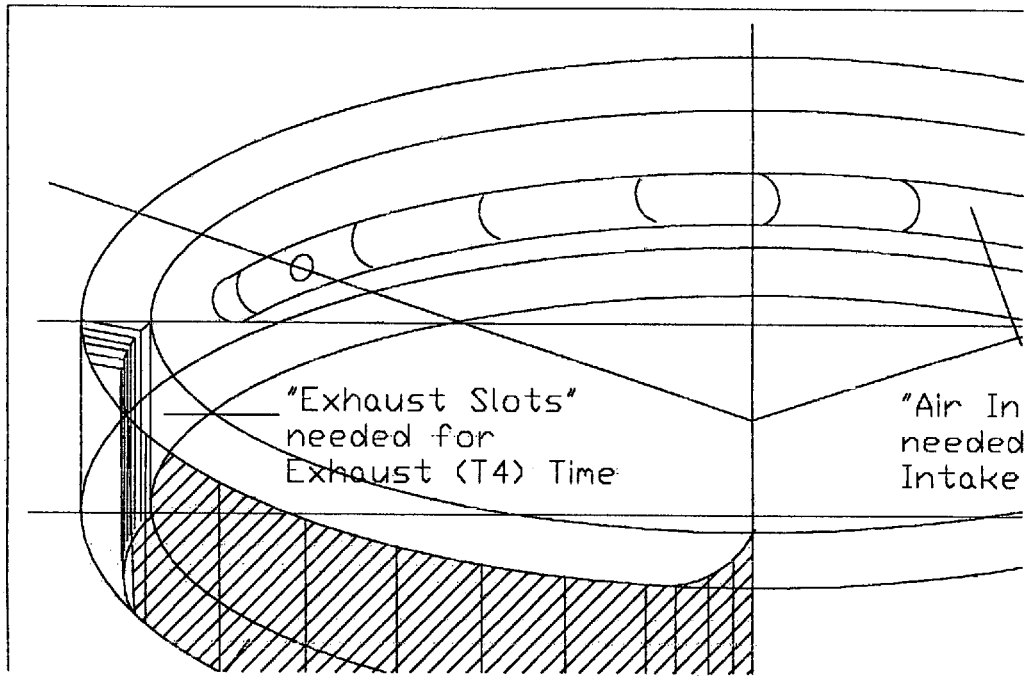

Figure10.2 (Stator - the block)
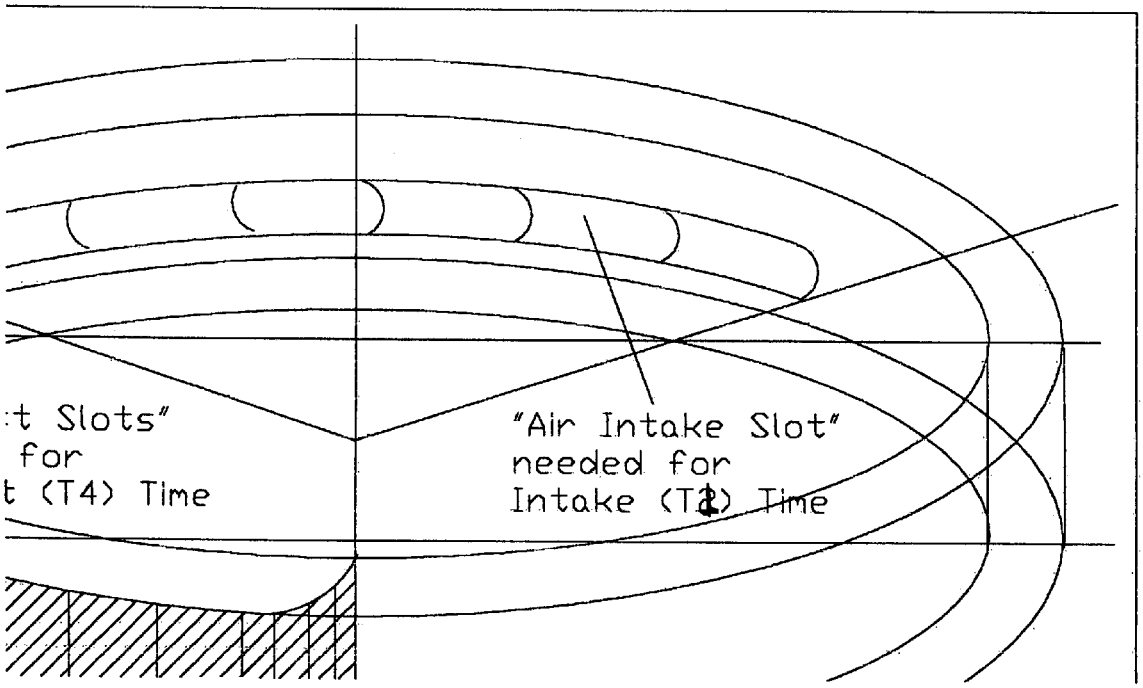

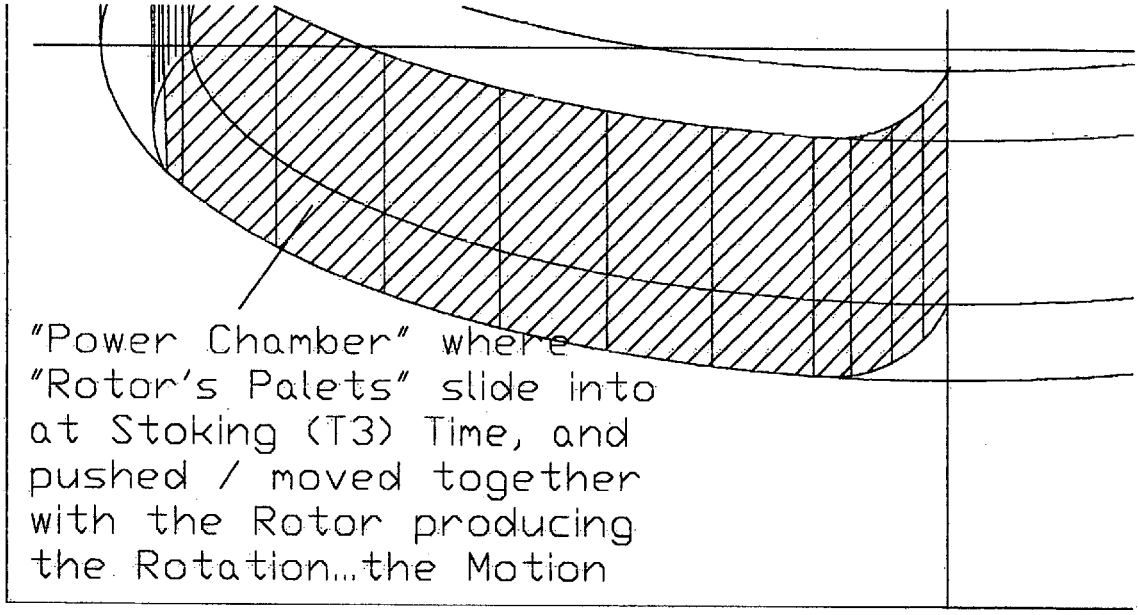
Figure10.3 (Stator - the block)

(SEE FIGS.)

Figure 12.K(Rotor - the block)
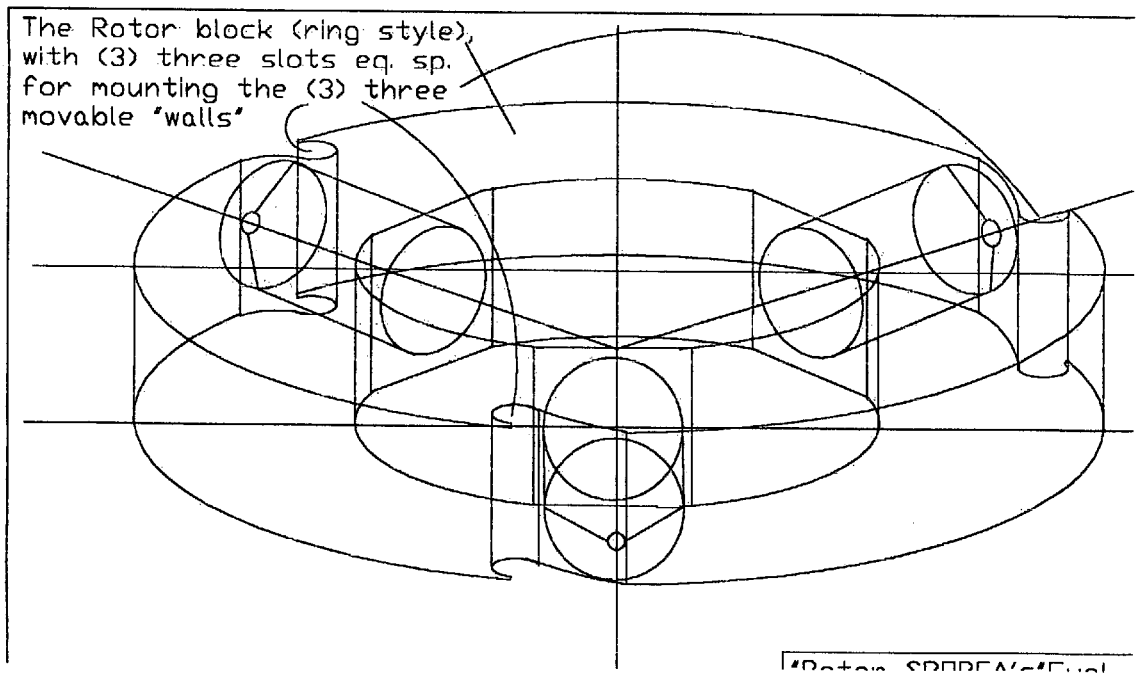

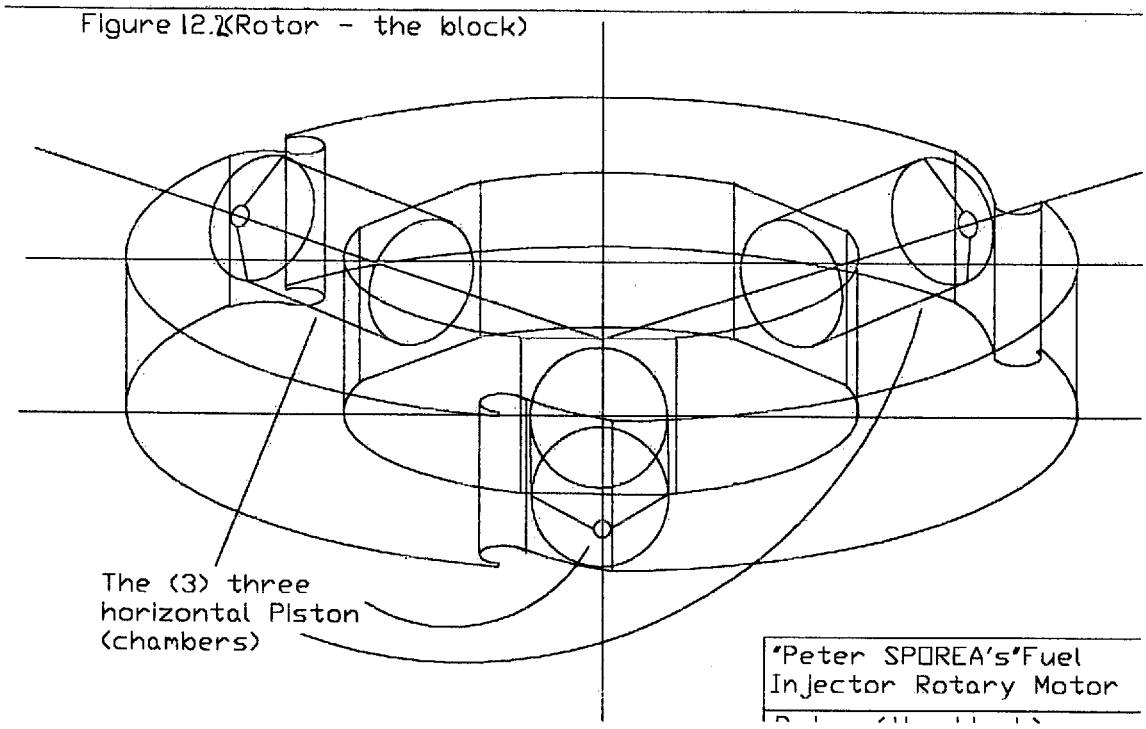
Figure 12.2(Rotor - the block)
The (3) three
horizontal Piston
(chambers)
'Peter SPOREA's'Fuel
Injector Rotary Motor (FIG. 2)

(SEE FIGS)

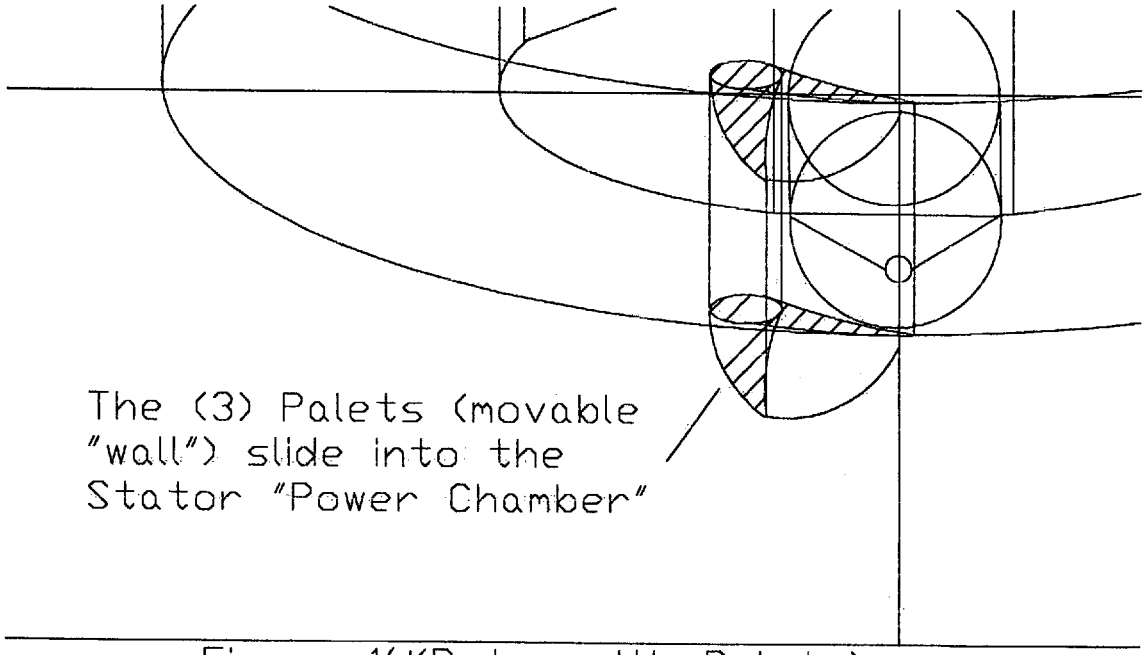
Figure 16.K(Rotor with Palets)

(SEE FIG.)

Figur 18.K(Rotor's compresion Shaft)
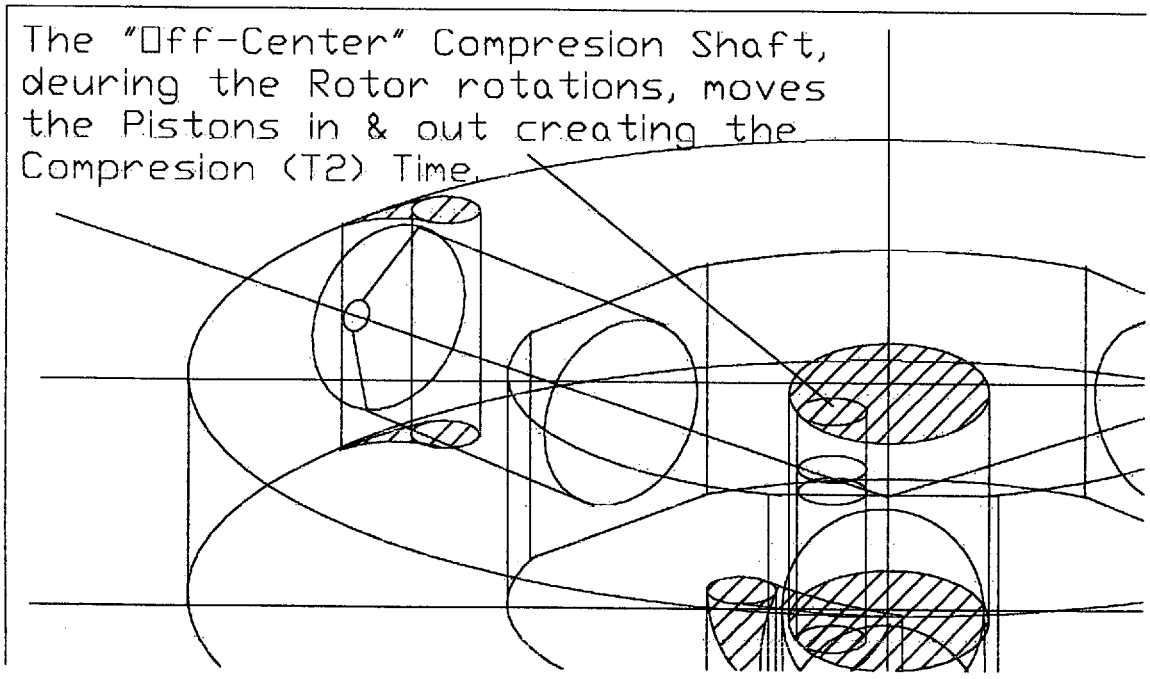

(SEE FIG.)

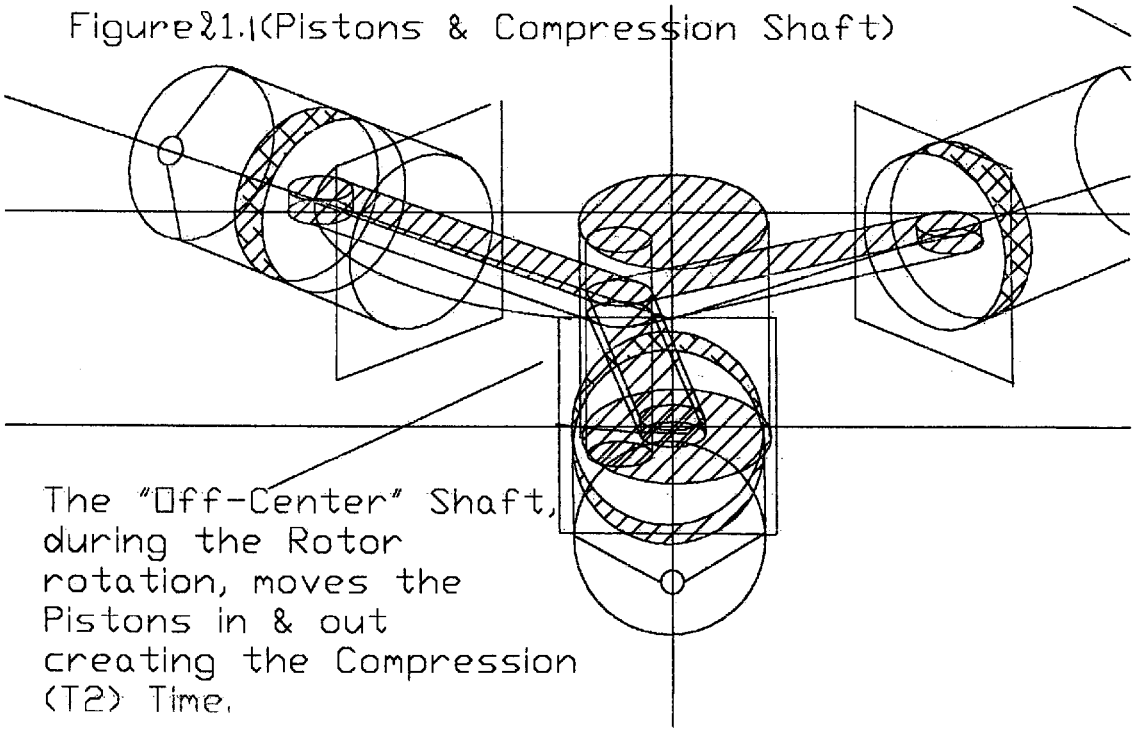
Figure21.1(Pistons & Compression Shaft)
The "Off-Center" Shaft, during the Rotor rotation, moves the Pistons in & out creating the Compression (T2) Time.

Peter SPOREA's Fuel Injector Rotary Motor
Page: 35 ; Figure: 22
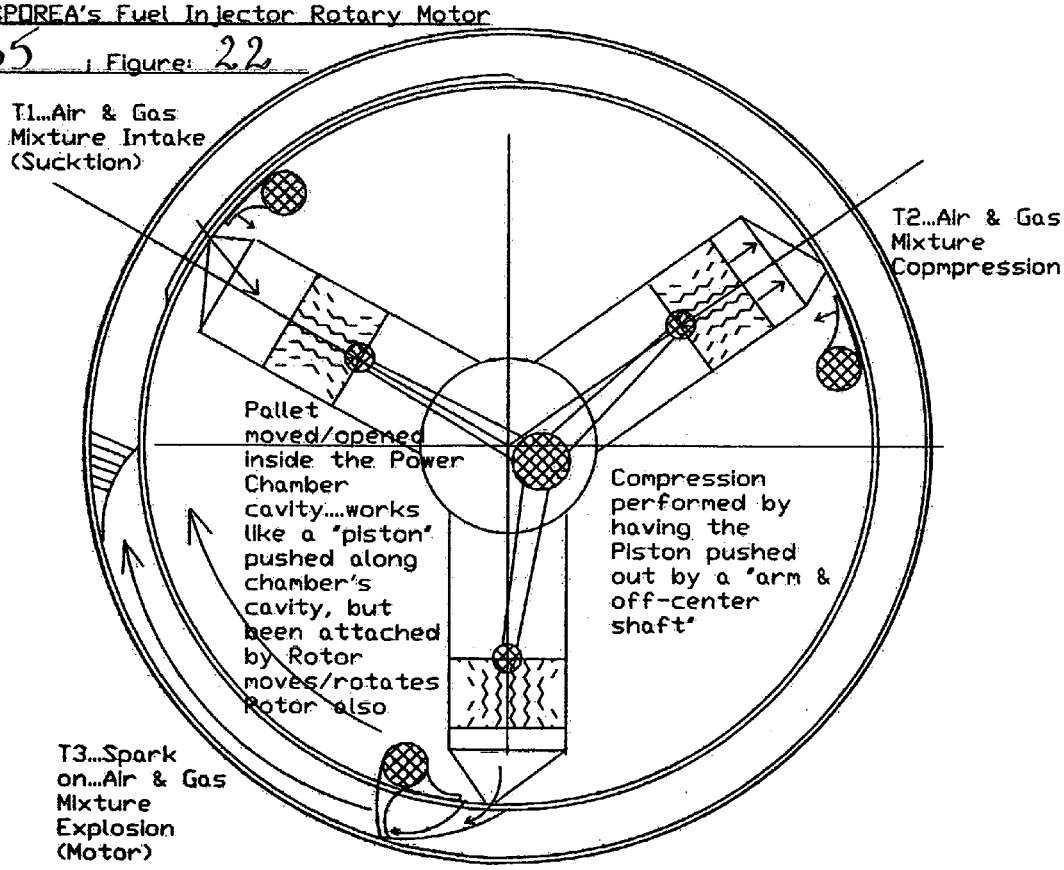

FIG. 22.1
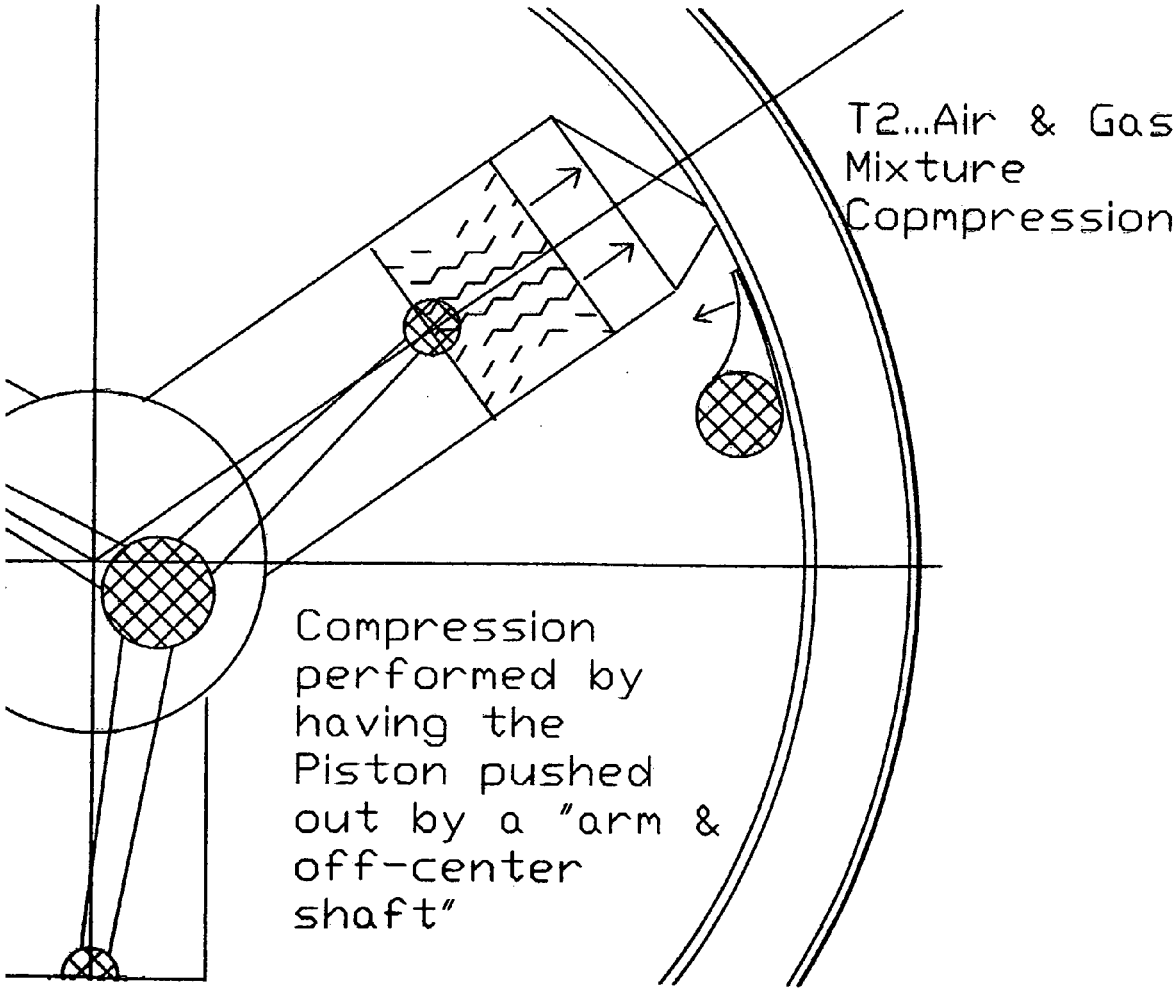

FIG. 22.2
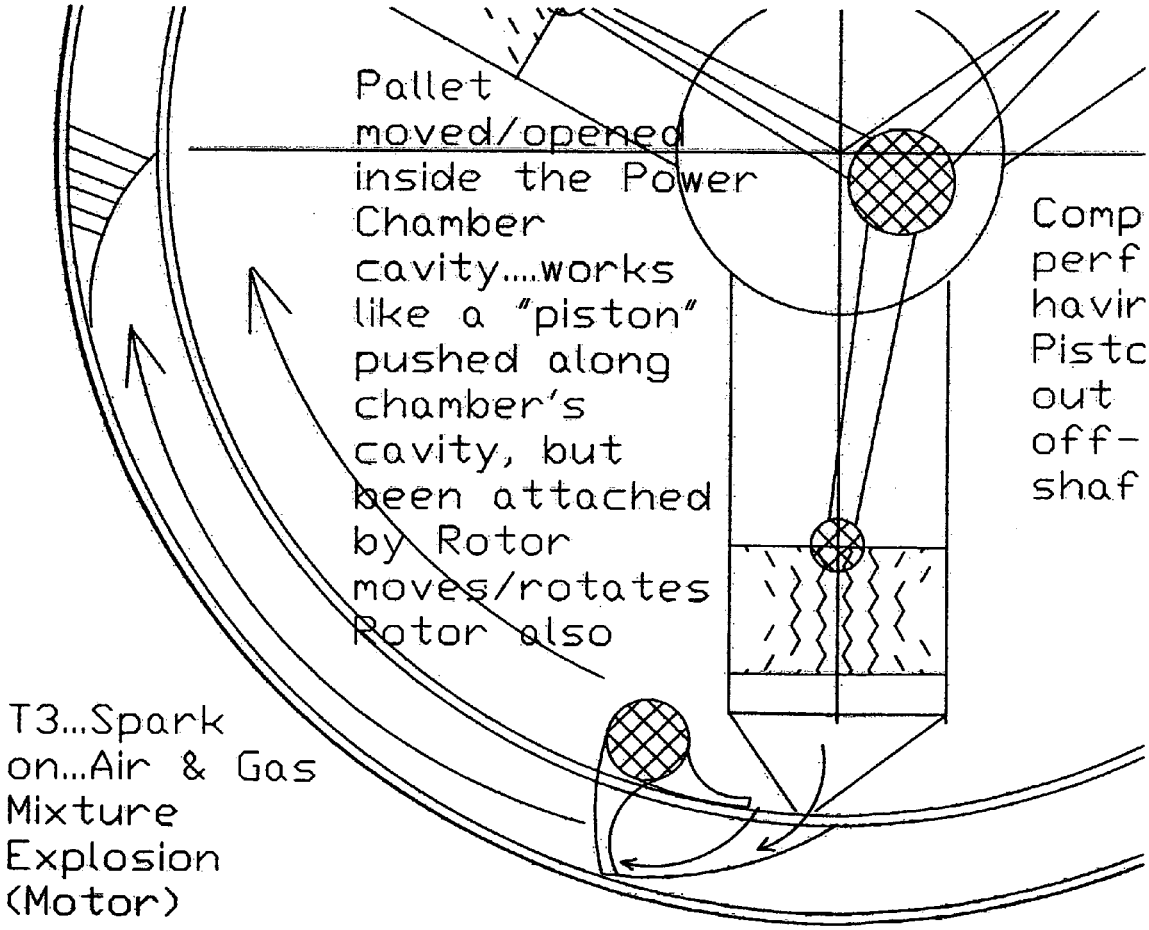

Peter SPUREA's Fuel Injector Rotary Motor Page: 38, Figure: 23
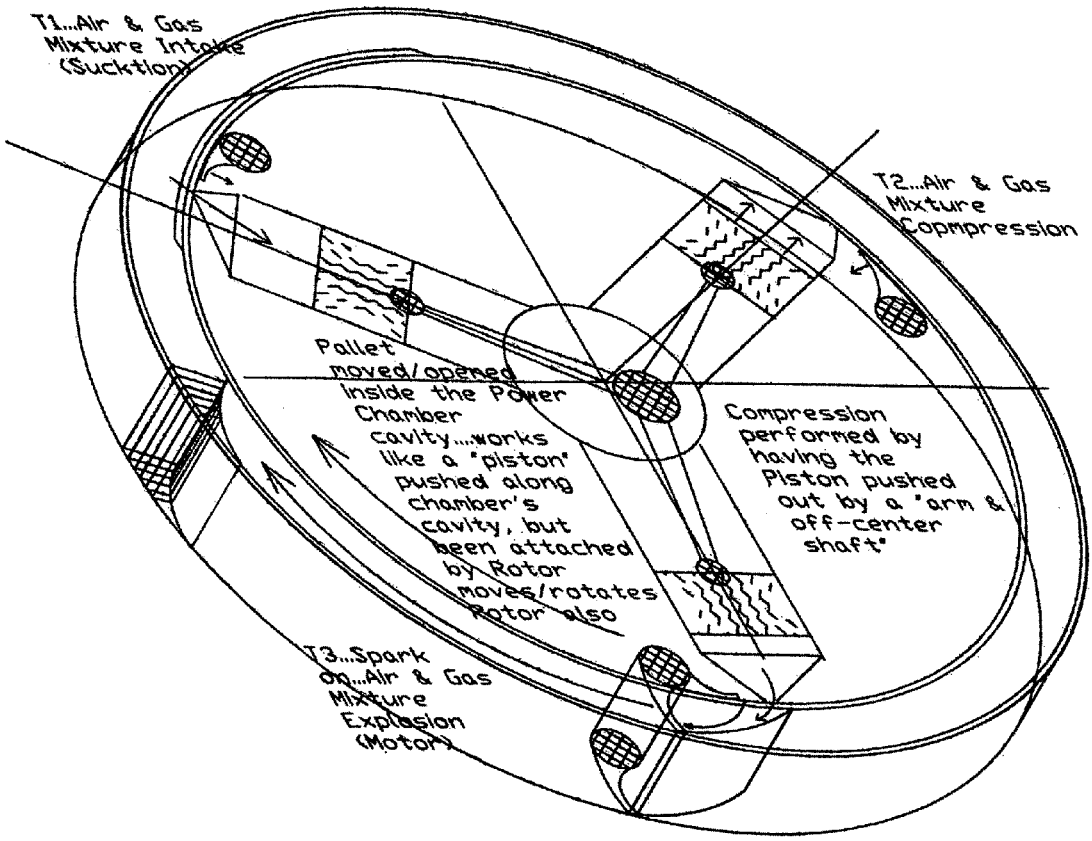

FIG. 23.1
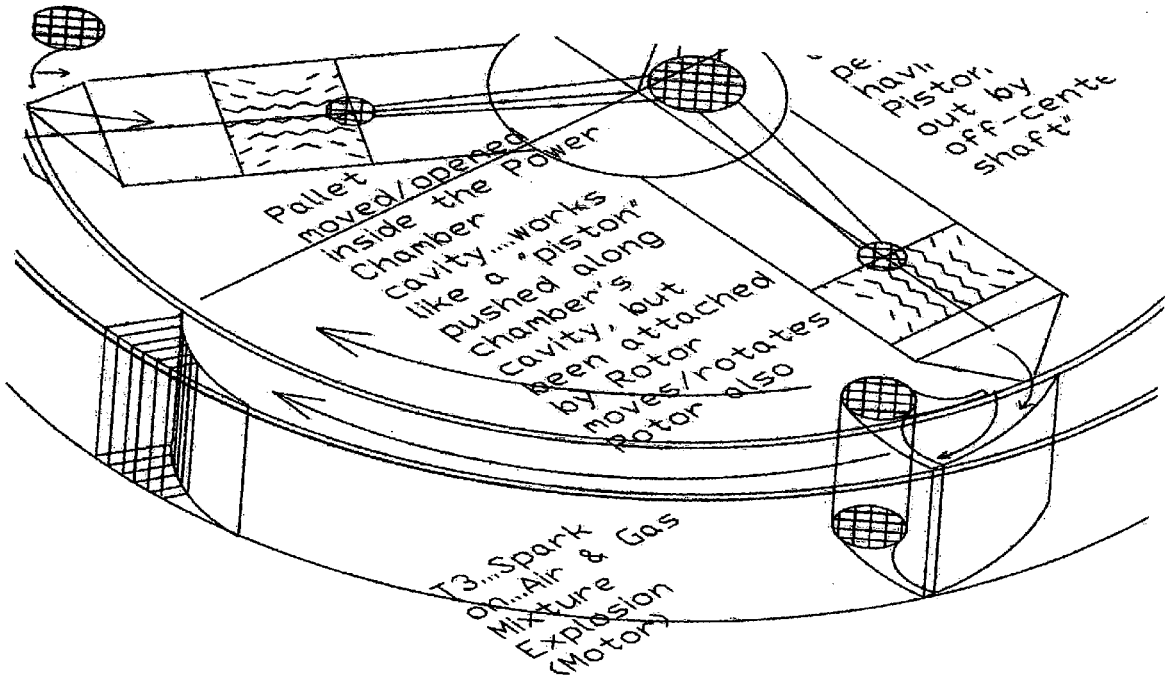

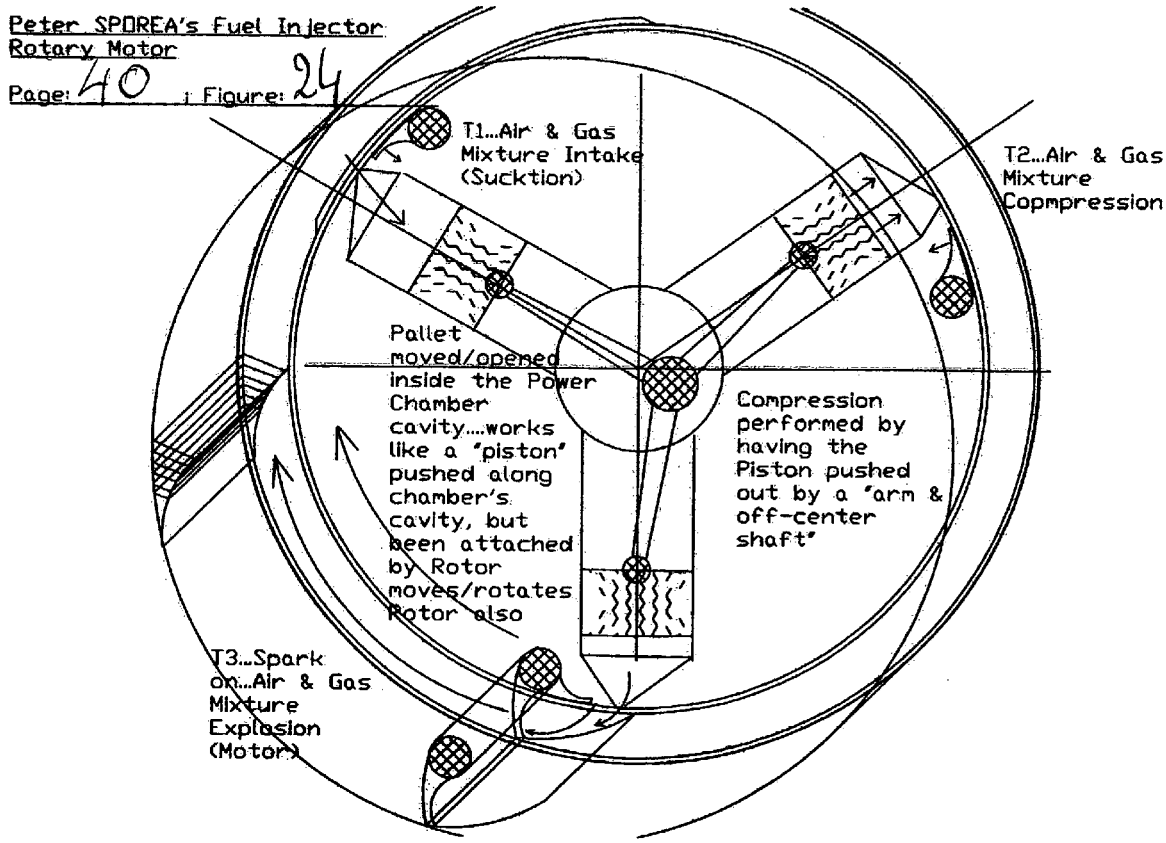
Peter SPOREA's Fuel Injector
Rotary Motor
Page: 40 ; Figure: 24
T1...Air & Gas
Mixture Intake
(Sucktion)
T2...Air & Gas
Mixture
Copmpression
Pallet
moved/opened
inside the Power
Chamber
cavity....works
like a 'piston'
pushed along
chamber's
cavity, but
been attached
by Rotor
moves/rotates
Rotor also
Compression
performed by
having the
Piston pushed
out by a 'arm &
off-center
shaft'
T3...Spark
on...Air & Gas
Mixture
Explosion
(Motor)

FIG 24.1
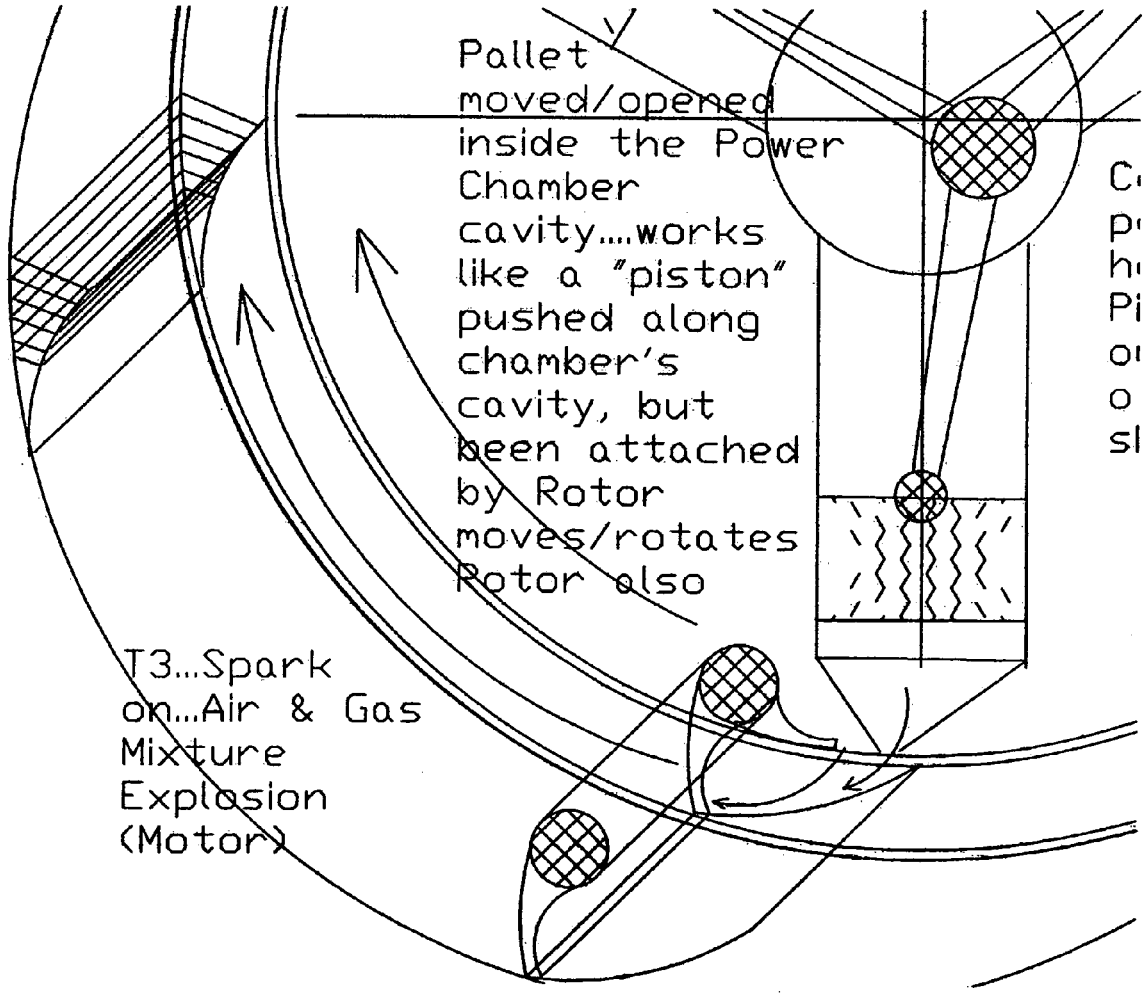

PETER SPOREA'S FUEL INJECTOR ROTARY MOTOR

BACKGROUND OF THE INVENTION

1. Field of the Invention

The present invention relates to Fuel injector Motors, and particular to producing the Torque Power directly from burning & exploded gases of compressed fuel & air mixture from Cylinders, placed into a Rotor, into the piston like Expandable Power Chamber from Stator, where the exploded gases have no other way to flow, than by pushing the Pallet, attached to the Rotor, and moved into Stator's Power Chamber piston like, forward . . . exactly like into regular Cylinder/Piston gases are contained, so the there is no Gases Pressure or Torque Power lost by Gases escape, the seal between Rotor's outer-wall & Stator's inner-wall has to be secured.

The presented Version of Invention has the Cylinders & Pistons placed into the Rotor, the inner moving & rotating & pinning unit around a cam or off-center shaft, and piston like Expendable Power Chamber placed into Stator, the outer nonmoving unit, but this Invention works as well as making the Inner Cylinders & Pistons Unit as nonmoving unit, and the Outer piston like Expendable Power Chamber Unit as the moving & rotating & spinning unit together the cam or off-center shaft.

The presented Version of Invention has the Rotor placed inside Stator, so the exploded gases flow toward outside, but this Invention works as well as placing the Rotor in-top-of Stator, so the exploded gases flow toward lower side.

Testing will decide which Version is the best version to be used.

2. Description of the Related Art

The attraction of Radial Engines having Cylinders Blocks, with Pistons executing a reciprocation motion, Rotating about a Stationary Crankshaft . . . led to many proposals, but most of them led to flow of exhaust gases from cylinders into turbine blades . . . which looks simple, . . . but where the gases pressure & torque power is diminished & lost quickly by freely gases escape, as a result the conventional Turbine Engines prevailed.

SUMMARY OF THE INVENTION

The present invention is directed to overcoming the problems outlined above with the object of providing an Internal Combustion Engine of high performance and high efficiency capable of running at high speed, which imply maintaining & using the ignited gases pressure & torque power at high.

The piston like Expandable Power Chamber from Stator, where Pallets, attached to the Rotor, and flipped & moved into Stator's piston like Power Chamber Cavity, at Ignition & Stroke Time, is solving the problem of loosing the ignited gases pressure met by the previous proposals of turbine with blade style.

The present invention is producing the Torque Power directly from ignited, burning & exploded gases of compressed fuel & air mixture from Cylinders into the piston like Expandable Power Chamber Cavity from Stator, where the Ignited & Exploded Gases have no other way to flow, than by pushing the Pallet forward . . . exactly like into regular Cylinder & Piston gases are contained, so the pressure lose by gases escape, as seen to turbine with blase style, is eliminated.

In accordance with the present invention, just 10%-20% increase in Ratio, means a lot, during this time of fuel prizes increase after every month.

Also by reducing the noise & pollution just by 20%-30%, during this time of very crowded cities, is also a major gain.

This Invention may be advantageously implemented to all different motors, from small to giants, from cars to trucks, from small power generators to big power plants . . . also as hybrids . . . so on

BRIEF DESCRIPTION OF THE DRAWINGS

The features of the invention believed to be novel are specifically set in the appended claims. However, the invention itself, both as to its structure and method of operation, may best be understood by referring to the following description and accompanying drawings.

FIG. 22 is motor's assembly & top thru view, stator with Power Chamber cavity & rotor with three (3) cylinders & pistons & Pallets & one central Compression shaft, where Pallets attached to Rotor move & flip into the Power Chamber cavity, working as piston like for the ignited, exploded gases flowing out from the cylinders into Power Chamber cavity FIG. 22.1 is T2 Compression Time, FIG. 22.2 is T3 Stroke Time, FIG. 23 is motor's ISOMETRIC View, for better view of Power Chamber cavity & Pallet . . . piston like style, FIG. 23.1 is T3 Stroke Time isometric view, FIG. 24 is motor's top isometric view, FIG. 24.1 is T3 Stroke isometric view.

DETAILED DESCRIPTION OF THE INVENTION

Figure 5:
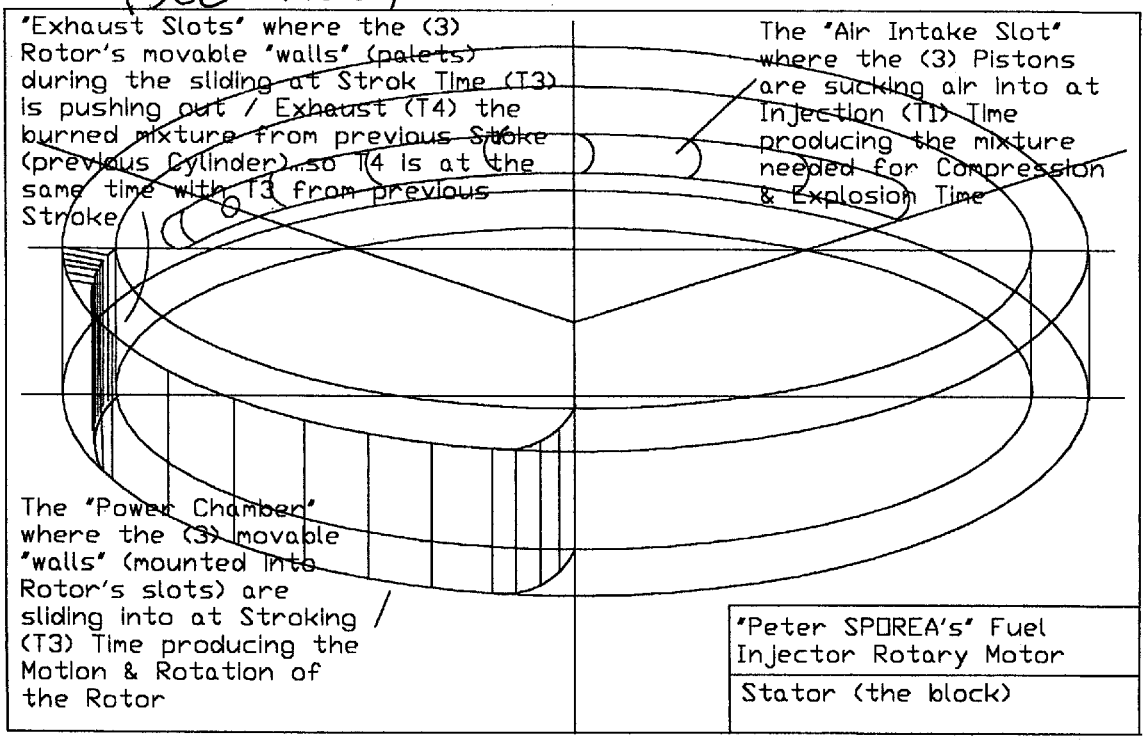
FIG. 5 is stator, the block, with Exhaust Slots, and Air Intake Slot, and Power Chamber cavity.
Figure 6:
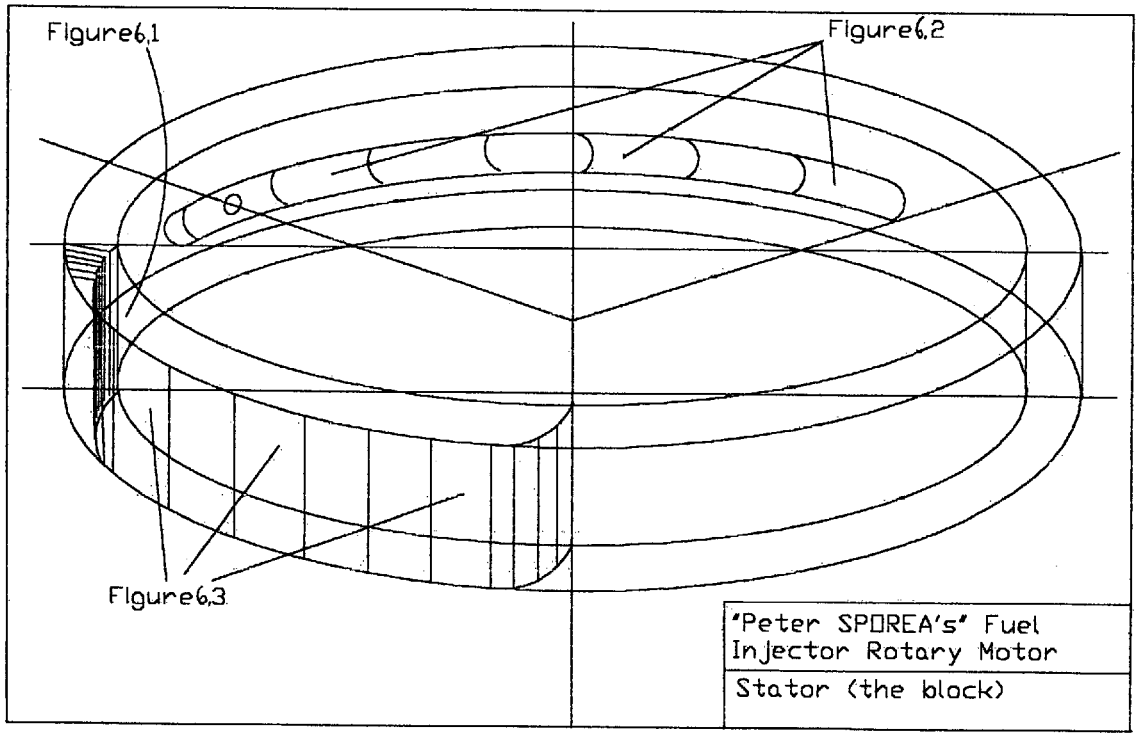
FIG. 6 is stator, the block, with FIGS. 6.1, 6.2 & 6.3, FIG. 6.1 is view of the Exhaust Slots for the gases, so T3 Stroke Time is also T4 Exhaust Time for gases from previous Cylinder stroke, FIG. 6.2 is view of the Air Intake Slot for air suction, which mixes with fuel, at T1 Injection Time, FIG. 6.3 is view of the Power Chamber cavity.
Figure 7:
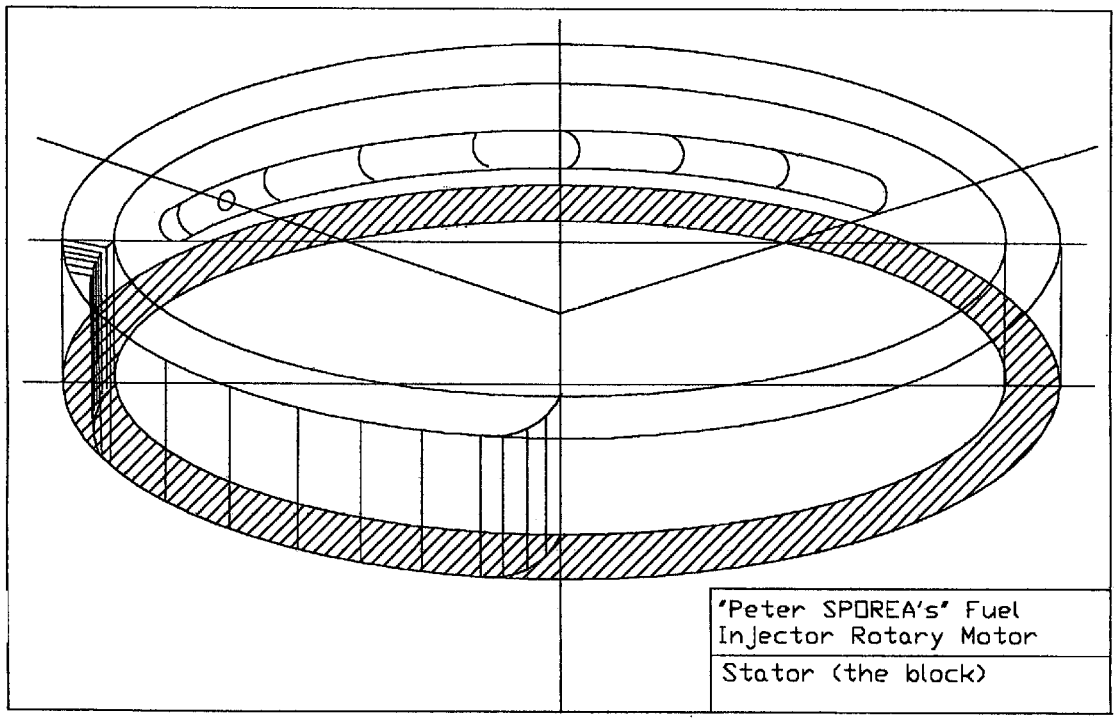
FIG. 7 is stator, the block, with a clear view of the bottom.
Figure 8:
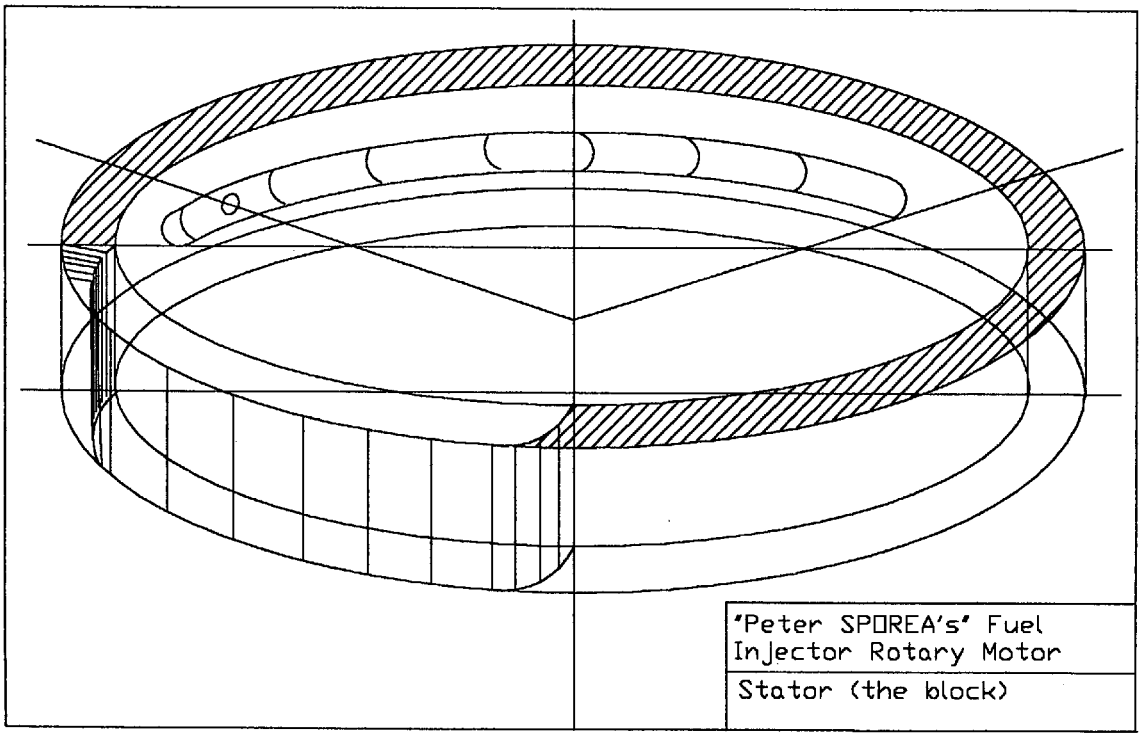
FIG. 8 is stator, the block, with a clear view of top, also the Power Chamber cavity.
Figure 9:
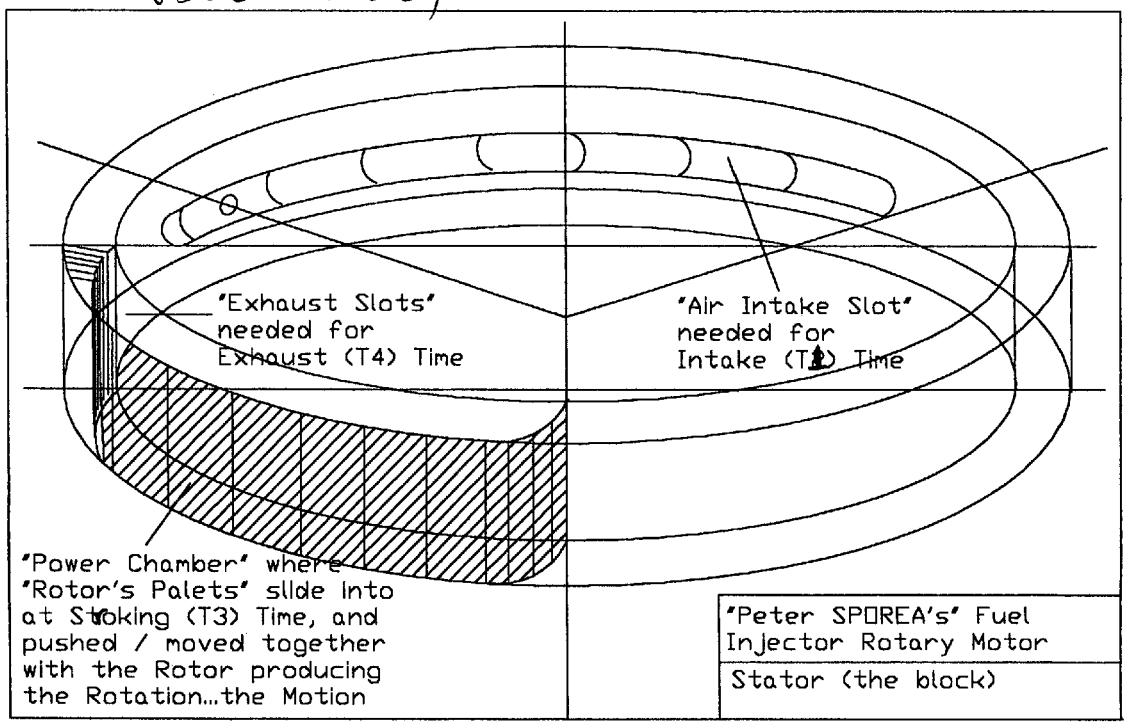
FIG. 9 is stator, the block, with a clear view of the Power Chamber cavity.
Figure 10:
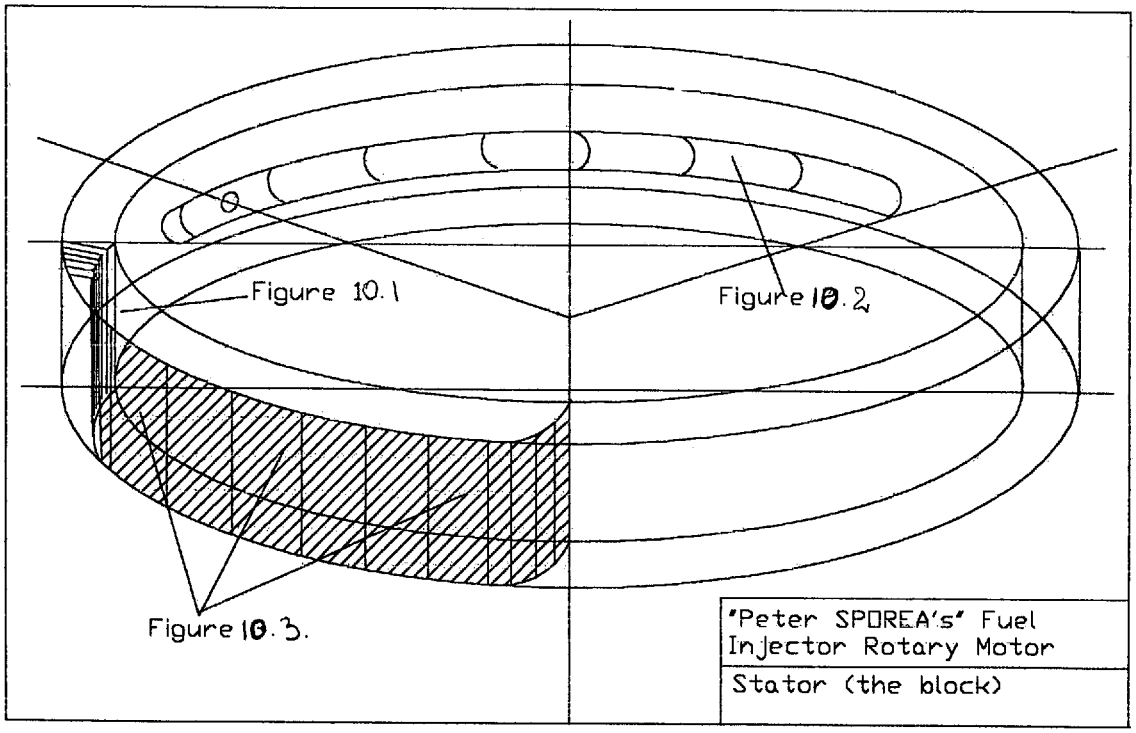
FIG. 10 is stator, the block, with FIGS. 10.1, 10.2 & 10.3, FIG. 10.2 is view of the Exhaust Slots, where the burned gazes will exhaust out, FIG. 10.2 is view of the Air Intake Slot, where the air is sucked in, FIG. 10.3 is view of Power Chamber cavity.
Figure 11:
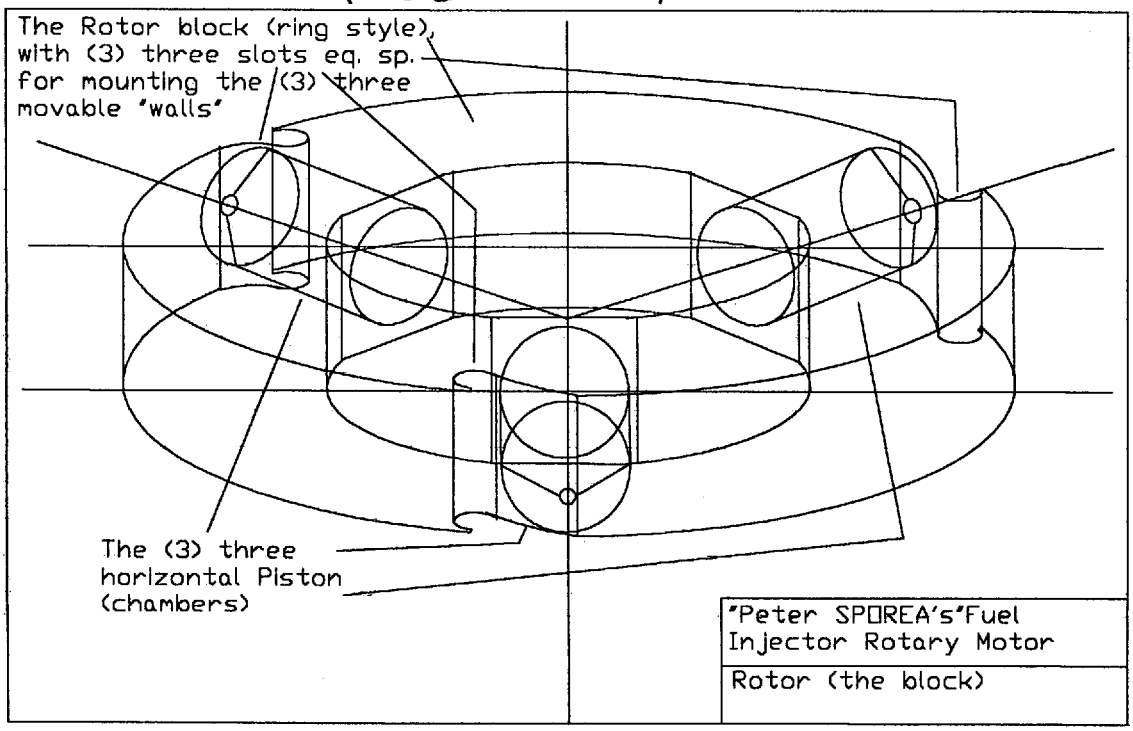
FIG. 11 is rotor, the block, with slots for Pallets mounting, and the cylinders & pistons.
Figure 12:
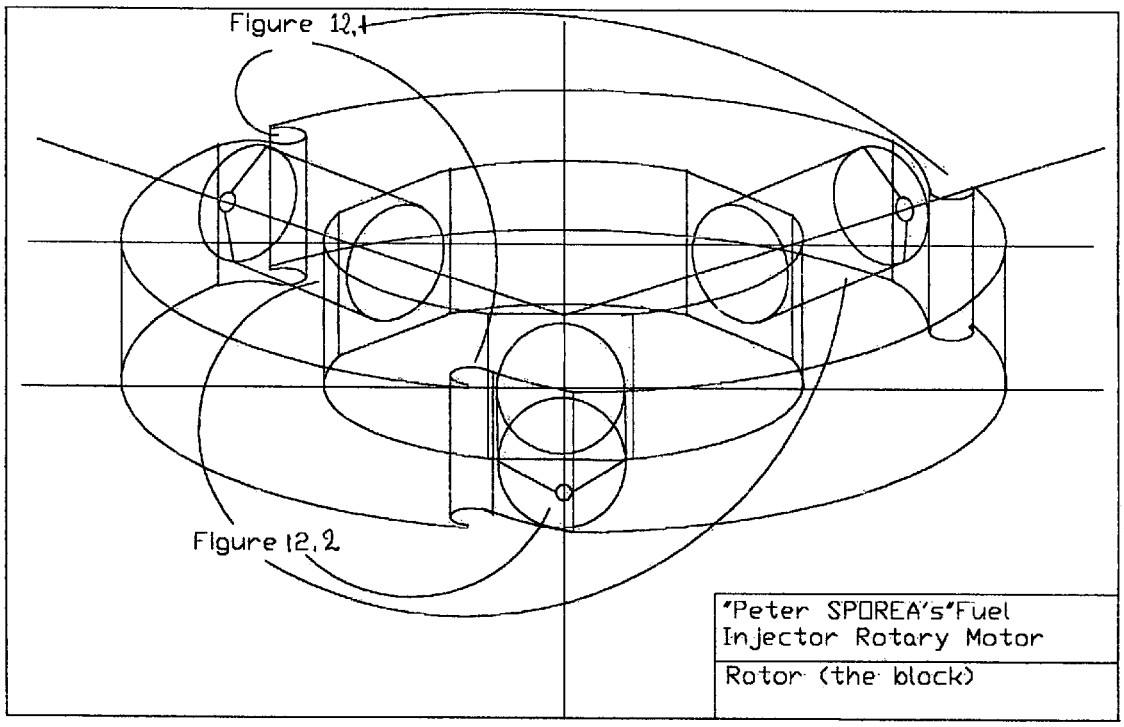
FIG. 12 is rotor, the block, with FIGS. 12.1, & 12.2, FIG. 12.1 is view of slots for Pallets mounting, FIG. 12.2 is view of Piston's Chamber.
Figure 13:
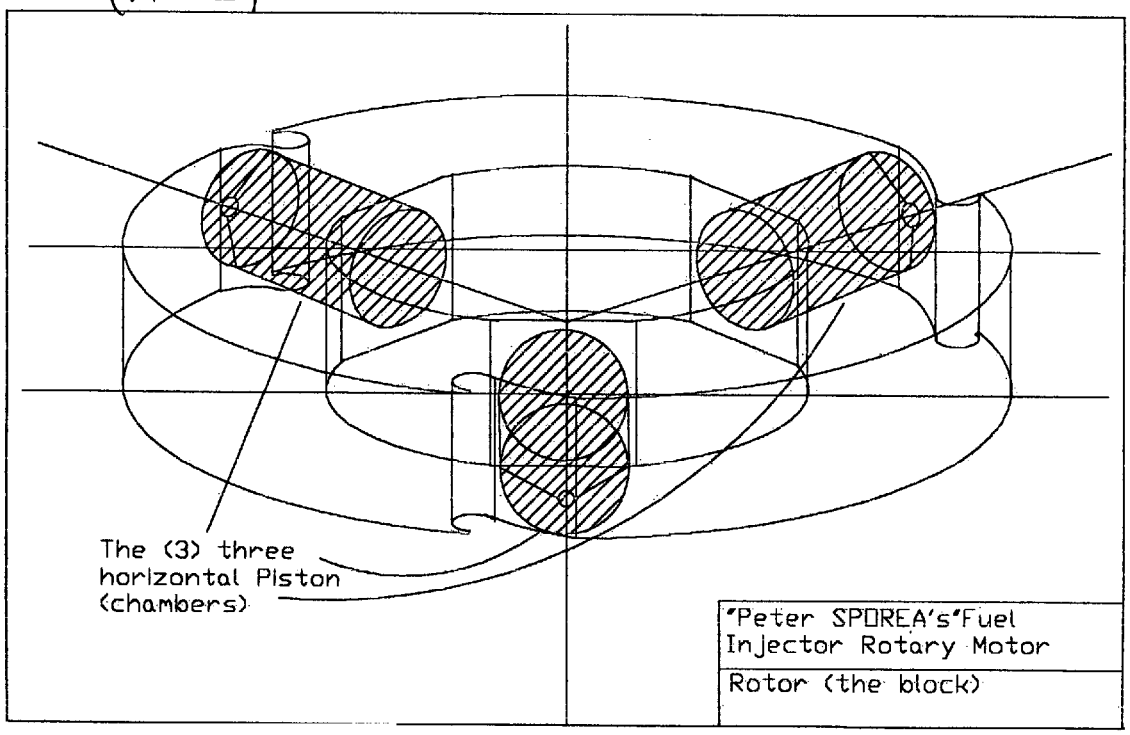
FIG. 13 is view of Piston's Chambers.
Figure 14:
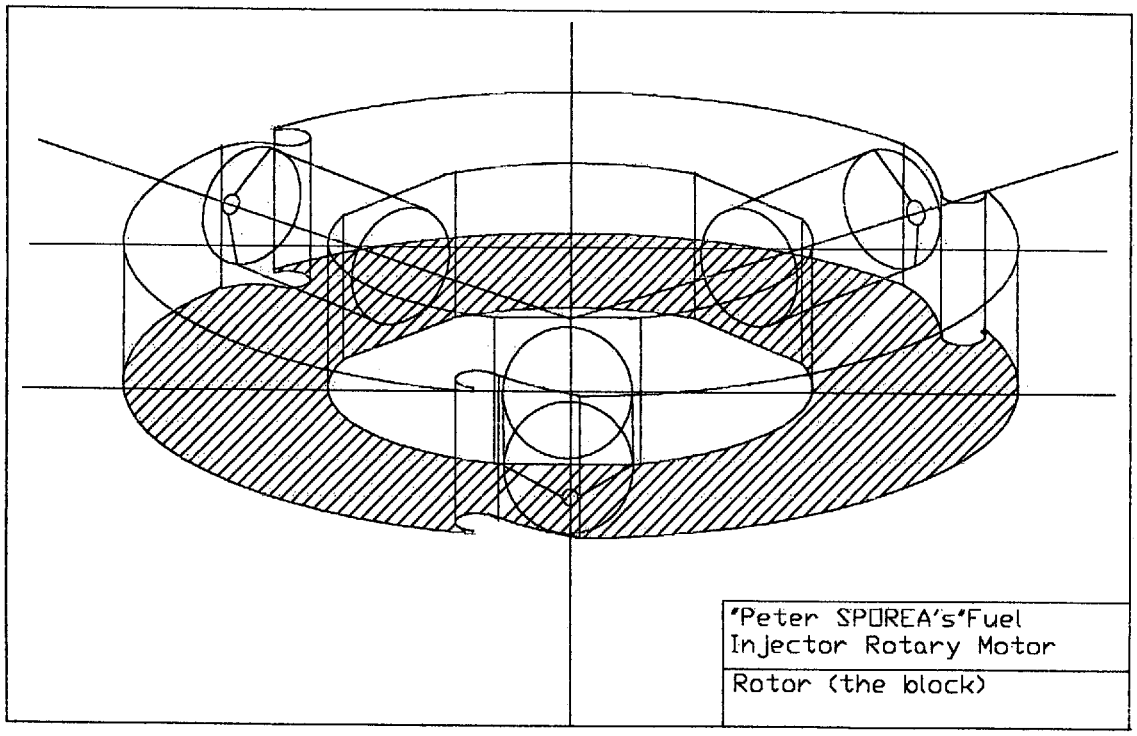
FIG. 14 is rotor, the block, with clear bottom view.

This Rotary engine with pistons, a stator and a power chamber, made from two (2) main parts:

see FIG. 22, FIG. 23 & FIG. 24;

1) a Stator, the non-moving unit, containing the Power Chamber cavity, where the ignited & burning & exploded gazes from Rotor's Cylinder will expend & flow, and a see FIG. 5, FIG. 6, FIG. 6.1, FIG. 6.3, FIG. 7, FIG. 8, FIG. 9, FIG. 10, FIG. 10.1, and FIG. 10.3, 2) Rotor, the moving & spinning unit, containing standard three (3) Cylinders & Pistons, producing the fuel & air mixture compression and ignition/explosion, also for each Cylinder a Pallet attached to Rotor, and movable & flip able into Power Chamber cavity as Stator's configuration allows.

see FIG. 11, FIG. 12, FIG. 12.1, FIG. 12.2, FIG. 13 & FIG. 14

Figure 1:
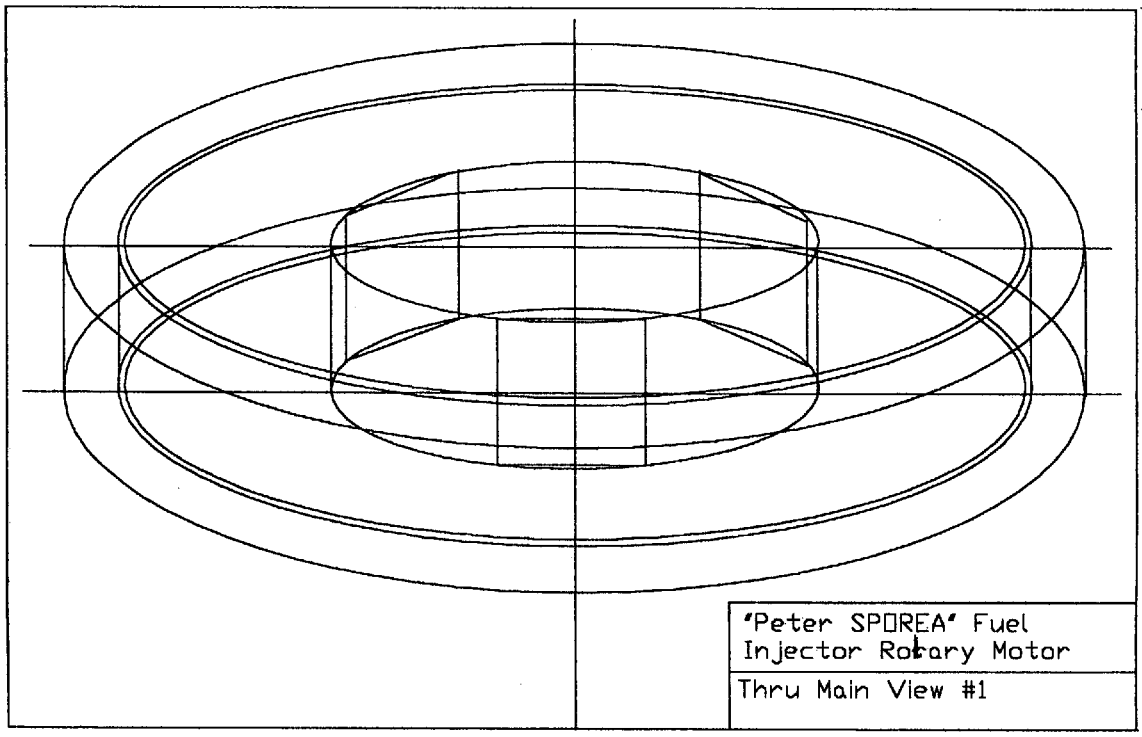
FIG. 1 is thru main view, of the stator & rotor
Figure 2:
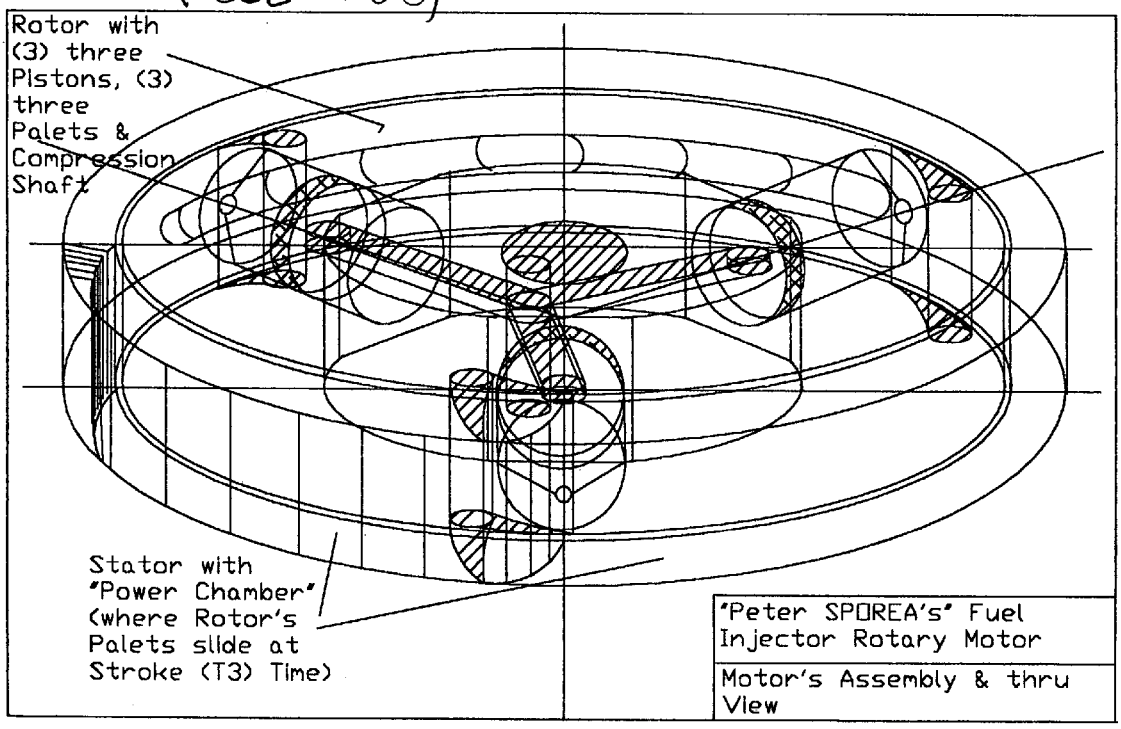
FIG. 2 is motor's assembly & thru view, stator with power chamber cavity & rotor with three (3) cylinders & pistons & pallets & one central compression shaft, where Pallets attached to Rotor move & flip into the Power Chamber Cavity, working as piston like for the ignited, exploded gases flowing out from the Cylinders into Power Chamber Cavity
Figure 3:
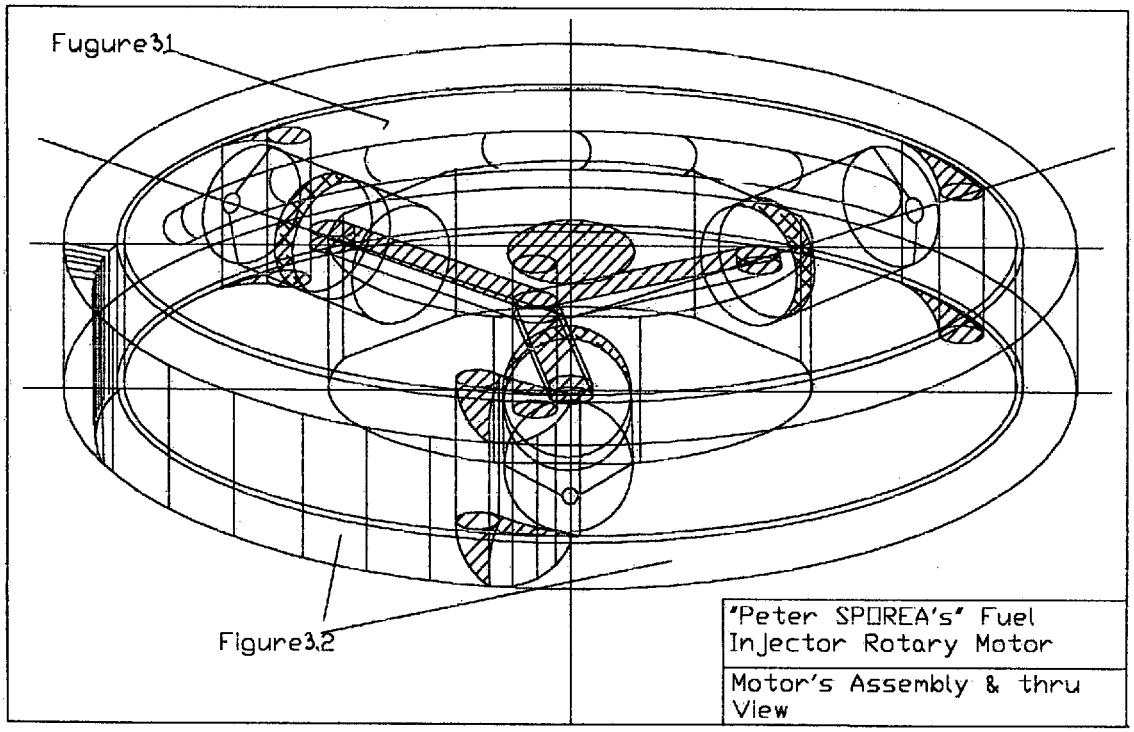
FIG. 3 is motor's assembly & thru view, with FIGS. 3.1 the rotor & 3.2 the stator FIG. 3.1 is view of the rotor's piston, pallet closed & flipped out of Power Chamber & the compression shaft FIG. 3.2 is view of the stator's power chamber cavity, where the Pallets slide & move & flip into the Power Chamber Cavity at T3 Stroke Time, working as piston like for the ignited, & exploded gases flowing out from the Cylinders, are pushed forward by gases pressure together with the Rotor attached to, FIG. 4 is motor's assembly & thru view, with a clear view of the bottom.
Figure 4:
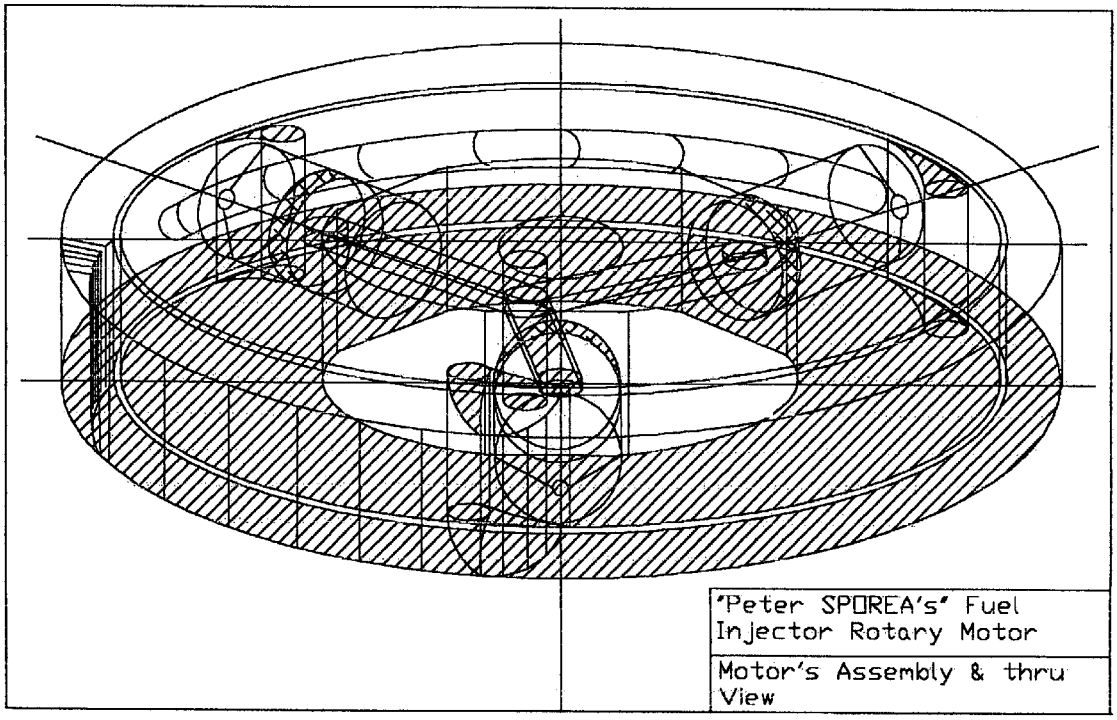
Figure 20:
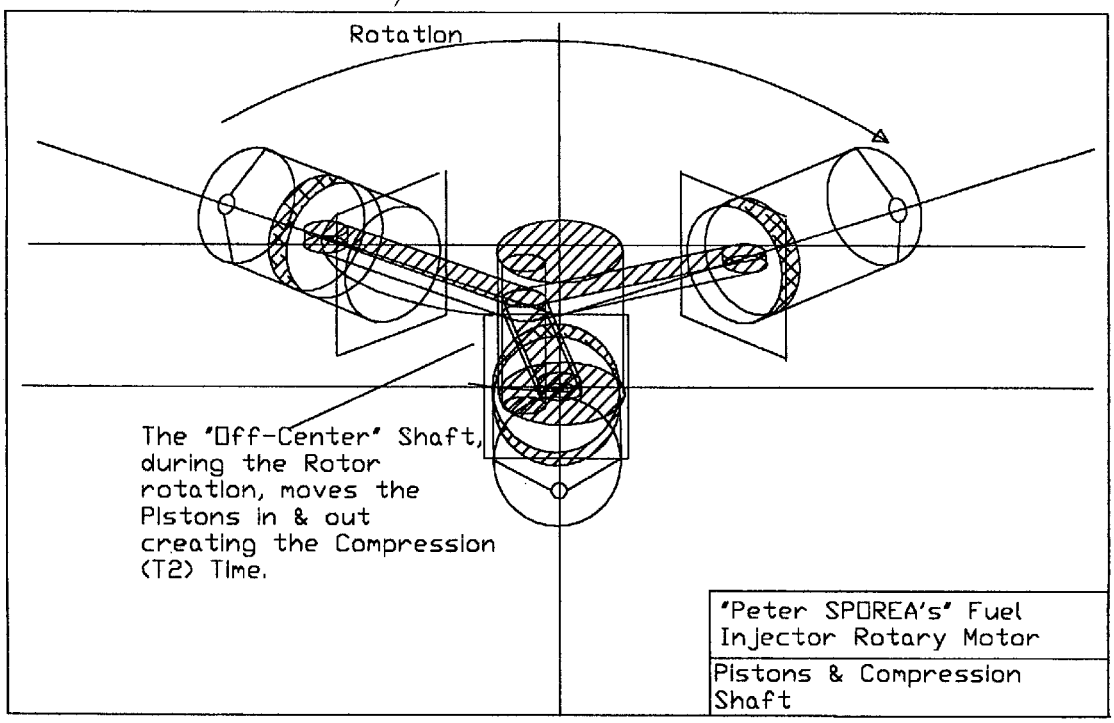
FIG. 20 is pistons & Compression Shaft, which is off-center, moving the pistons in, for compression . . . and out, for sucking the air.
Figure 21:
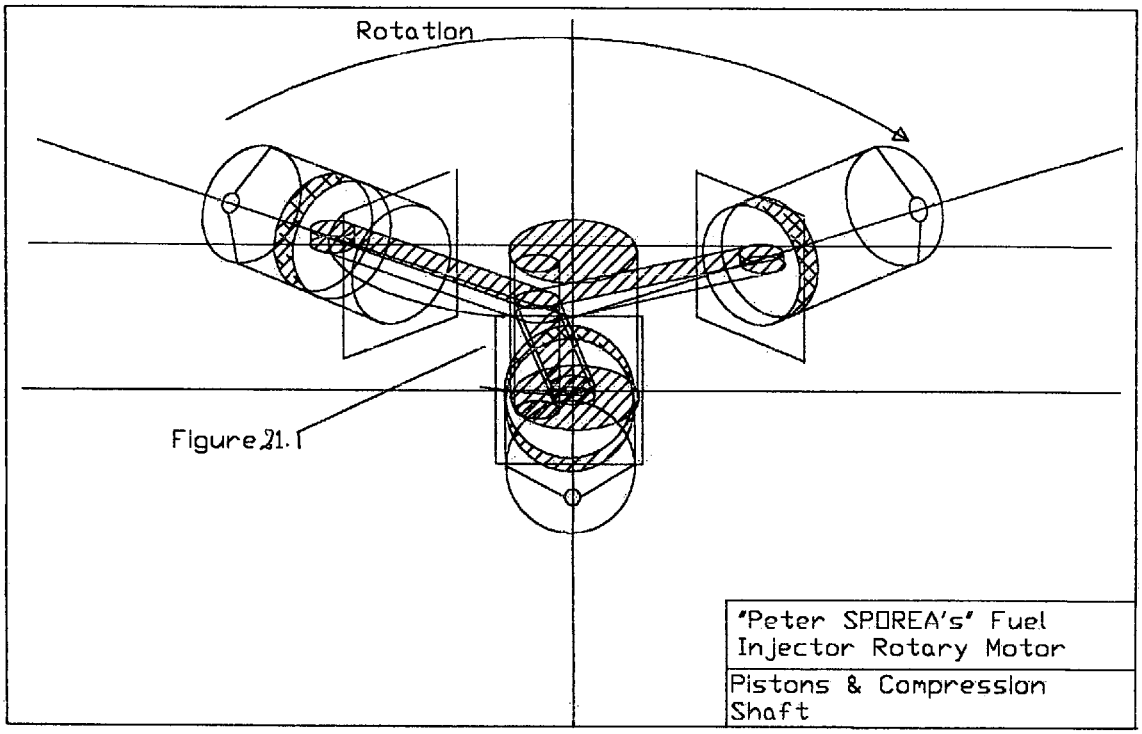
FIG. 21 is piston & Compression Shaft, FIG. 21.1, FIG. 21.1 is view of pistons & Compression Shaft.

As the Rotor rotates & spins ⅓ of turn, each of the three (3) Rotor's Cylinders with Pistons (see FIGS. 2, 22 & 23) reaches the Air Intake Slot area from the Stator (see FIG. 5), where the Off-Center Shaft from center moves & pulls the Piston toward the center (see FIG. 20), sucking & injecting the air & gas mixture into the Cylinder, which is T1 Suction & Injection Time.

Than, as the Rotor rotates & spins another ⅓ of turn, each of the three (3) Pistons from Rotor's Cylinders (see FIG. 2, 22.1, & 23) are moved & pushed away the center by Off-Center Shaft (see FIG. 20), compressing the air & gas mixture into the Cylinder, which is T2 Compression Time.

Than, as the Rotor rotates & spins another ⅓ of turn, each of the three (3) Rotor's Cylinders with Pistons (see FIG. 2, 22.2, 23.1 & 24.1) have the Sparks ignites/fire the compressed air & gas mixture, producing the ignition/explosion/stroke of the burning air & gas mixture, which is T3 Stroke Time.

Figure 15:
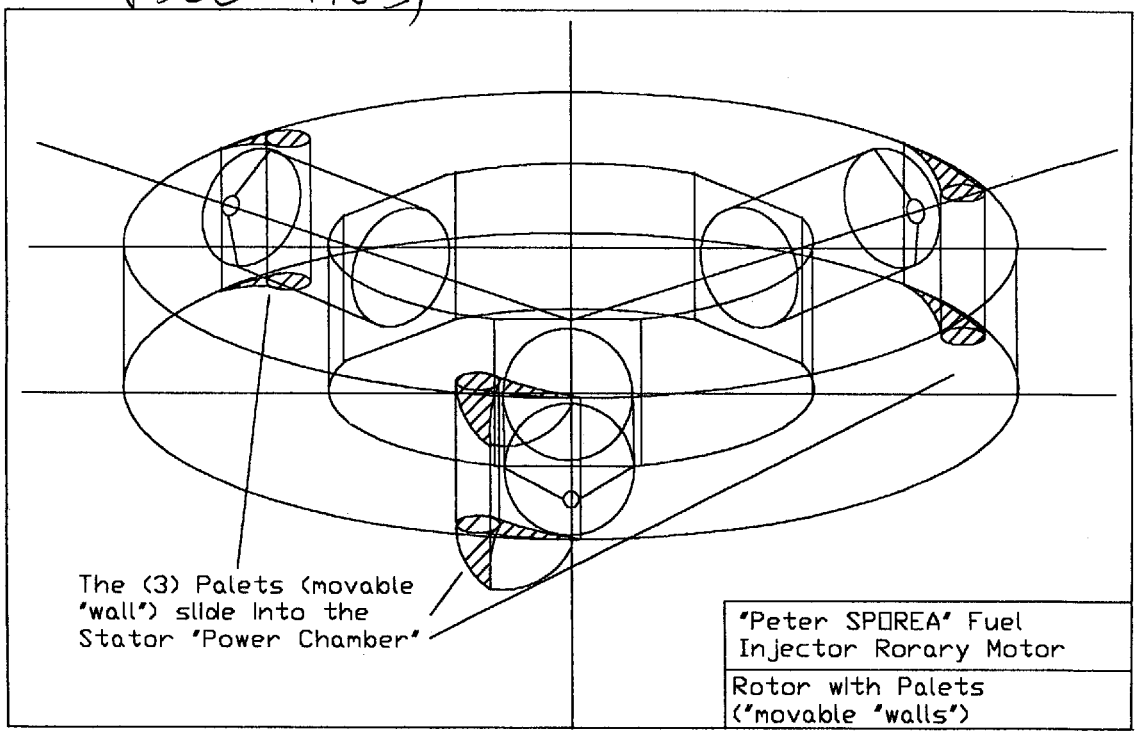
FIG. 15 is rotor with movable & flip able Pallets, kept in position toward Rotor by Stator's wall, and moved & flipped outside Rotor cavity inside Power Chamber's Cavity at Stroke Time.
Figure 16:
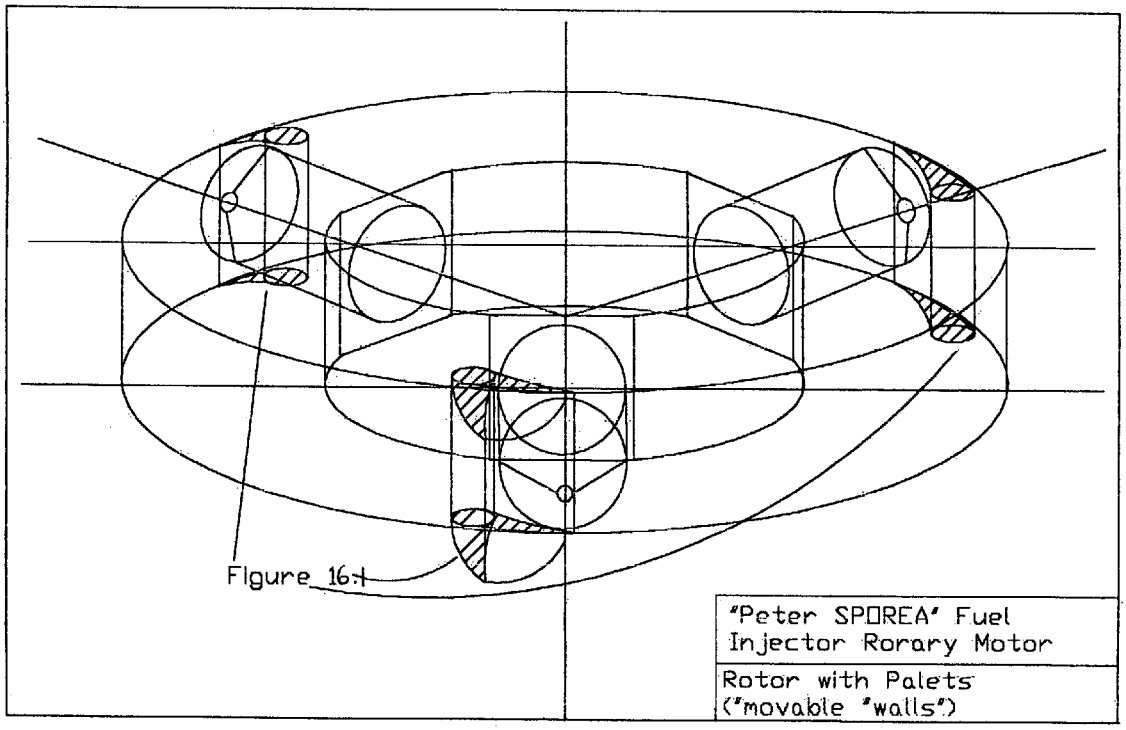
FIG. 16 is rotor with Pallets, FIG. 16.1, FIG. 16.1 is view of movable & flip able Pallets
Figure 17:
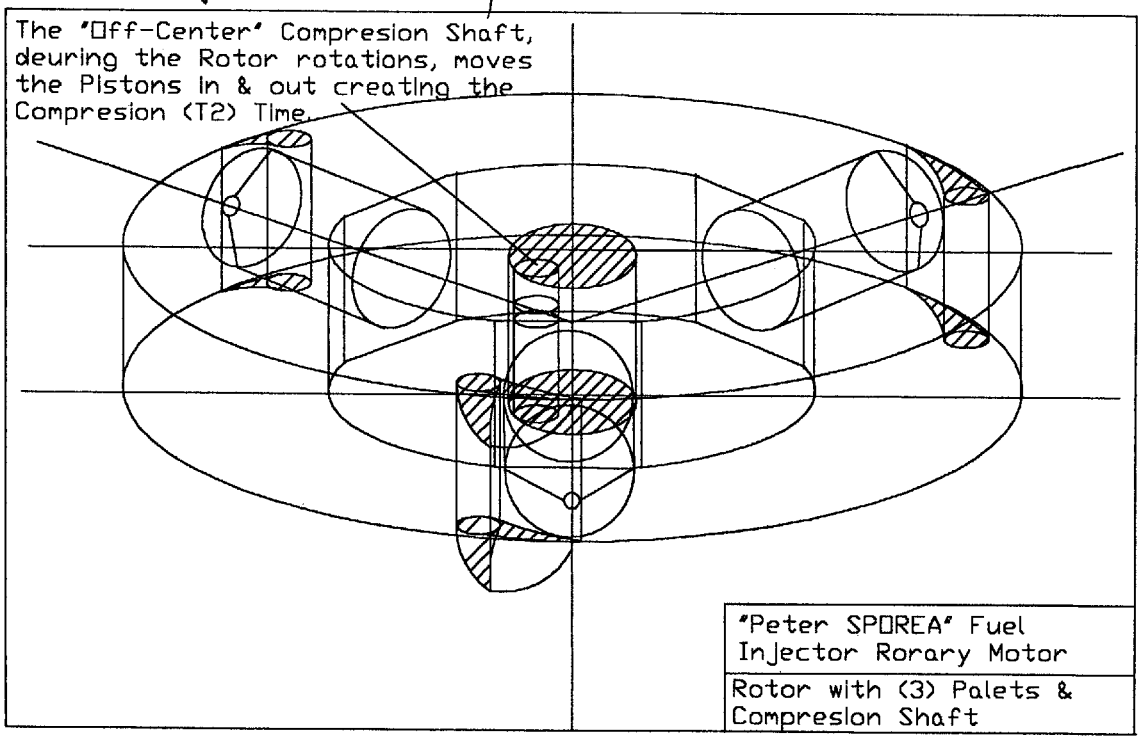
FIG. 17 is rotor with movable & flip able Pallets, and Compression Shaft.
Figure 18:
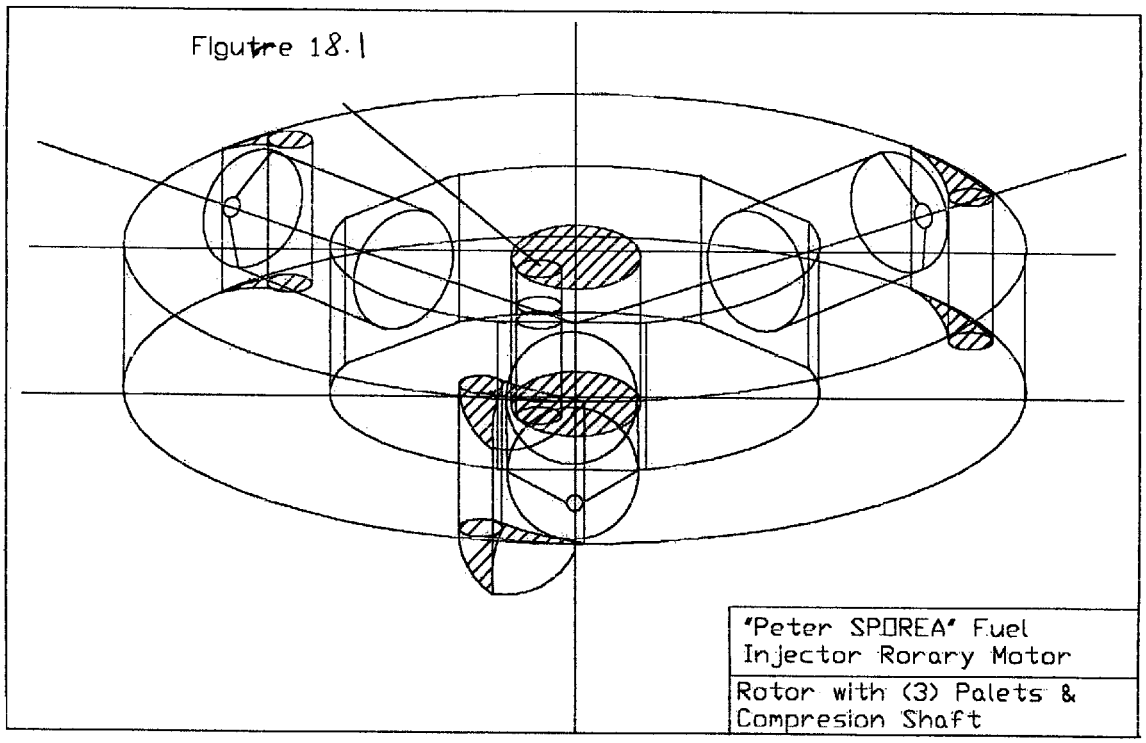
FIG. 18 is rotor with Pallets, and Compression Shaft, FIG. 18.1, FIG. 18.1 is view of Compression Shaft.
Figure 19:
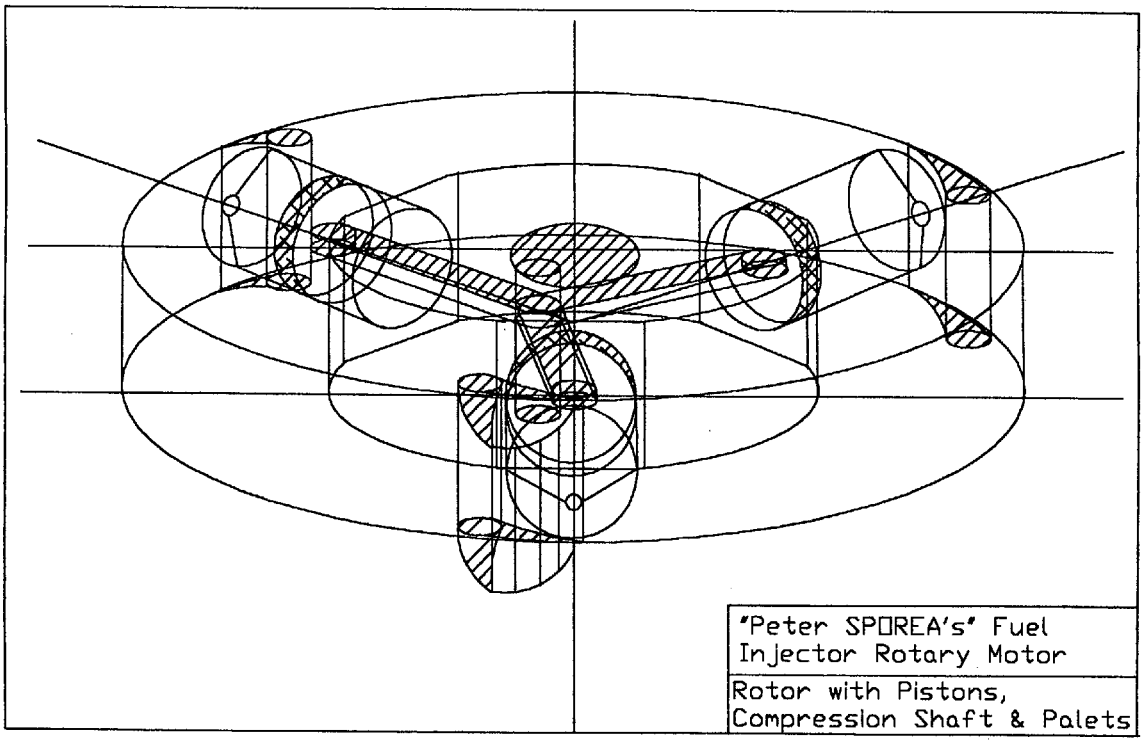
FIG. 19 is rotor, with pistons, movable & flip able Pallets, & Compression Shaft.

The ignited & exploding burning air & gas mixture need to expend pushing against the Piston, but this pistons are held in position by the Off-Center Shaft (see FIG. 20), unlike the conventional Fuel Injector Motors, then the Rotor's Cylinder reaches the Stator's Power Chamber cavity where the Rotor's Pallets move & flip into (see FIGS. 2 & 5), and the exploding burning air & gas mixture are allowed to flow & expend, pushing against the Rotor's Pallets, moving the Rotor.

see FIG. 15, FIG. 16, FIG. 16.1, FIG. 17, and FIG. 18

As the Pallets move & flip into the power Chamber, they push out the burned air & gas mixture from previous Stroke toward Exhaust Slots, which is T4 Exhaust Time, at the same time with T3.

This new Fuel Injector Rotary Motor:

is producing the Torque Power directly from flowing of ignited, burning & exploded gases of compressed fuel & air mixture from Rotor's Cylinders into the Power Chamber Cavity from Stator, producing the Torque Power at higher Ratio, directly to Rotary Motion & Spinning of the Rotor;

is a lower fuel consumption motor, also a lower noise motor by using the directly rotary motion (by eliminating the piston arms up & down motion & drive shaft, as a Torque Power;

is lower fuel consumption motor by using the Pallets attached to the Rotor, and sliding against Stator wall during the Injection & Compression Time, and inside Power Chamber cavity at Stroke Time, piston like style, with no power torque & gases pressure lost.

What is claimed is:

1. A rotary engine with pistons, a stator and a power chamber comprising:

the stator, an inside of which contains the power chamber for combusting a mixture of fuel and air; an air intake slot, exhaust slots and the power chamber located along an inside periphery of stator;

a rotor containing three of said pistons and three cylinders that create compression of the mixture of fuel and air;

an eccentric shaft for attachment to said pistons, said eccentric shaft moving said pistons in a inwardly and outwardly direction;

the rotor further containing three pallets, which create a movable wall at an outer circumferential periphery of the rotor, said walls slide into the power chamber cavity of the stator;

a rotor block with three equally spaced slots for mounting the three pallets, the pallets, moving into the power chamber cavity during ignition of the compressed fuel and air mixture to enable the pallets and rotor to be pushed along the power chamber cavity, creating the rotation of the rotor;

where in the rotary engine operation consists of:

an injection time T1 where the air and gas mixture is sucked into the intake slot to produce the mixture needed for compression and explosion;

a compression time T2 where the fuel and air mixture is compressed by eccentric shaft against the pistons as the rotor rotates;

a power stroke time T3 where a spark ignites the air and gas mixture to create an explosion;

and exhaust time T4, where the exhaust of burned fuel and air mixture is pushed out, the time T3 occurring at the same time as time T4 of the adjacent cylinder.

* * * * *